US011659347B2

(12) United States Patent
Igarashi et al.

(10) Patent No.: US 11,659,347 B2
(45) Date of Patent: May 23, 2023

(54) INFORMATION PROCESSING APPARATUS, INFORMATION PROCESSING METHOD, AND ACOUSTIC SYSTEM

(71) Applicant: SONY CORPORATION, Tokyo (JP)

(72) Inventors: Go Igarashi, Tokyo (JP); Naoki Shinmen, Tokyo (JP); Kohei Asada, Tokyo (JP); Chisata Numaoka, Tokyo (JP); Yoshiyuki Kuroda, Tokyo (JP)

(73) Assignee: SONY CORPORATION, Tokyo (JP)

( * ) Notice: Subject to any disclaimer, the term of this patent is extended or adjusted under 35 U.S.C. 154(b) by 3 days.

(21) Appl. No.: 17/250,434

(22) PCT Filed: May 8, 2019

(86) PCT No.: PCT/JP2019/018335

§ 371 (c)(1),
(2) Date: Jan. 21, 2021

(87) PCT Pub. No.: WO2020/026548

PCT Pub. Date: Feb. 6, 2020

(65) Prior Publication Data

US 2021/0345057 A1 Nov. 4, 2021

(30) Foreign Application Priority Data

Jul. 31, 2018 (JP) ..... JP2018-144017

(51) Int. Cl.

| | |
|---|---|
| ***H04S 7/00*** | (2006.01) |
| ***G10K 15/02*** | (2006.01) |
| ***H04R 1/40*** | (2006.01) |
| ***H04R 3/12*** | (2006.01) |

(52) U.S. Cl.

CPC ..... *H04S 7/303* (2013.01); *H04S 2420/01* (2013.01)

(58) Field of Classification Search

None

See application file for complete search history.

(56) References Cited

U.S. PATENT DOCUMENTS

2013/0036452 A1 2/2013 Yamashita
2015/0156599 A1 6/2015 Romigh
(Continued)

FOREIGN PATENT DOCUMENTS

CN 102915734 A 2/2013
CN 110036655 A 7/2019
(Continued)

OTHER PUBLICATIONS

International Search Report and Written Opinion of PCT Application No. PCT/JP2019/018335, dated Jul. 16, 2019, 10 pages of ISRWO.

(Continued)

*Primary Examiner* — Qin Zhu
(74) *Attorney, Agent, or Firm* — Chip Law Group

(57) ABSTRACT

Provided is an information processing apparatus that carries out a process of deriving a head related transfer function. The information processing apparatus includes a detection unit that detects a position of a head of a user, a storage unit that stores a head related transfer function of the user, a determination unit that determines a position of a sound source for measuring the head related transfer function of the user based on the position of the head detected by the detection unit and information stored in the storage unit, a control unit that controls the sound source to output measurement signal sound from the position determined by the determination unit, and a calculation unit that calculates the head related transfer function of the user based on collected sound data obtained by collecting, at the position of the head, the measurement signal sound output from the sound source.

19 Claims, 21 Drawing Sheets

(56) References Cited

U.S. PATENT DOCUMENTS

| | | | | |
|---|---|---|---|---|
| 2015/0312694 | A1* | 10/2015 | Bilinski | H04S 7/302 381/1 |
| 2016/0119731 | A1 | 4/2016 | Lester, III | |
| 2016/0373877 | A1* | 12/2016 | Laitinen | H04S 7/304 |
| 2017/0164085 | A1 | 6/2017 | Romigh | |
| 2018/0192226 | A1* | 7/2018 | Woelfl | H04R 5/02 |
| 2020/0068334 | A1 | 2/2020 | Magariyachi et al. | |

FOREIGN PATENT DOCUMENTS

| | | | |
|---|---|---|---|
| EP | 3554098 | A1 | 10/2019 |
| JP | 2007-251248 | A | 9/2007 |
| JP | 2013-033368 | A | 2/2013 |
| JP | 2014-99797 | A | 5/2014 |
| JP | 2017-16062 | A | 1/2017 |
| WO | 2016/065137 | A1 | 4/2016 |
| WO | 2017/135063 | A1 | 8/2017 |
| WO | 2018/110269 | A1 | 6/2018 |

OTHER PUBLICATIONS

Morise, et al., Warped-TSP: An Acoustic Measurement Signal Robust to Background Noise and Harmonic Distortion, Electronics and Communications in Japan, Part 3, vol. 90, No. 4, XP001504053, Jan. 1, 2007, pp. 18-26.

Extended European Search Report of EP Application No. 19845437.3, dated Aug. 27, 2021, 10 pages.

* cited by examiner

| MEASUREMENT POINT No. | POSITION | DISTANCE | POSITION-BASED TIME AXIS WAVEFORM INFORMATION | POSITION-BASED HRTF | MEASURED FLAG | PRIORITY |
|---|---|---|---|---|---|---|
| 1 | | | | | | |
| 2 | | | | | | |
| 3 | | | | | | |
| ... | ... | ... | ... | ... | ... | ... |
| N | | | | | | |

INFORMATION PROCESSING APPARATUS, INFORMATION PROCESSING METHOD, AND ACOUSTIC SYSTEM

CROSS REFERENCE TO RELATED APPLICATIONS

This application is a U.S. National Phase of International Patent Application No. PCT/JP2019/018335 filed on May 8, 2019, which claims priority benefit of Japanese Patent Application No. JP 201 8-1 4401 7 filed in the Japan Patent Office on Jul. 31, 2018. Each of the above-referenced applications is hereby incorporated herein by reference in its entirety.

TECHNICAL FIELD

A technique disclosed in the present specification mainly relates to an information processing apparatus, an information processing method, and an acoustic system that process acoustic information.

BACKGROUND ART

In an acoustic field, there is a known technique for using a head related transfer function (HRTF) of a user to increase reproducibility of stereophonic sound. The HRTF largely depends on the shapes of the head and the auricles of the user, and it is desirable that the user be the subject in measuring the head related transfer function.

However, in a conventional measurement method of the head related transfer function, special equipment provided with a large number of speakers is necessary, and opportunities for the measurement of the user are limited. It is difficult to use the head related transfer functions directly measured from the user to reproduce the stereophonic sound. Therefore, a method is often used, in which a dummy head microphone simulating the head including the ears is used to measure and set head related transfer functions of an average user, and the stereophonic sound for individual users is reproduced.

For example, a head related transfer function selection apparatus is proposed that selects the head related transfer function suitable for the user from a database including a plurality of head related transfer functions (see PTL 1). However, the head related transfer function selection apparatus uses the head related transfer function considered to be close to the user among the head related transfer functions with average characteristics registered in the database. Therefore, compared to the case of using the head related transfer function obtained by directly measuring the user, it cannot be denied that the sense of realism is reduced in reproducing the stereophonic sound.

In addition, an apparatus is proposed that measures head related transfer functions simulating propagation characteristics of sound propagating from each direction to the ears (see PTL 2). However, the apparatus uses a large speaker traverse (movement apparatus) to measure head related transfer functions at equal intervals, and large-scale equipment is necessary. Therefore, it is considered that the measurement burden of the user as a subject is large.

On the other hand, a control apparatus is proposed that acquires a positional relation between the head or the ear of the user and the sound source from an image captured by a smartphone held by the user and that causes the smartphone to generate sound to simply measure the head related transfer function (see PTL 3). However, there is a demand for a head related transfer function measurement technique that increases the measurement accuracy without imposing a measurement burden on the user as much as possible.

CITATION LIST

Patent Literature

[PTL 1]
Japanese Patent Laid-Open No. 2014-99797
[PTL 2]
Japanese Patent Laid-Open No. 2007-251248
[PTL 3]
Japanese Patent Laid-Open No. 2017-16062

SUMMARY

Technical Problem

An object of the technique disclosed in the present specification is to provide an information processing apparatus, an information processing method, and an acoustic system that carry out a process for deriving a head related transfer function.

Solution to Problem

The technique disclosed in the present specification has been made in view of the problem, and a first aspect of the technique provides an information processing apparatus including a detection unit that detects a position of a head of a user, a storage unit that stores a head related transfer function of the user, a determination unit that determines a position of a sound source for measuring the head related transfer function of the user based on the position of the head detected by the detection unit and information stored in the storage unit, and a control unit that controls the sound source to output measurement signal sound from the position determined by the determination unit. In addition, the information processing apparatus further includes a calculation unit that calculates the head related transfer function of the user based on collected sound data obtained by collecting, at the position of the head, the measurement signal sound output from the sound source.

The determination unit determines a position of a sound source for measuring the head related transfer function of the user next without overlapping the position where the head related transfer function is already measured, thereby allowing to efficiently measure the head related transfer function.

In addition, a second aspect of the technique disclosed in the present specification provides an information processing method including a detection step of detecting a position of a head of a user, a determination step of determining a position of a sound source for measuring a head related transfer function of the user based on the position of the head detected in the detection step and information stored in a storage unit that stores the head related transfer function of the user, and a control step of controlling the sound source to output measurement signal sound from the position determined in the determination step.

In addition, a third aspect of the technique disclosed in the present specification provides an acoustic system including a control apparatus and a terminal apparatus. The control apparatus includes a detection unit that detects a position of a head of a user, a storage unit that stores a head related transfer function of the user, a determination unit that determines a position of a sound source for measuring the head related transfer function of the user based on the position of the head detected by the detection unit and information stored in the storage unit, a control unit that controls the sound source to output measurement signal sound from the position determined by the determination unit, and a calculation unit that calculates the head related transfer function of the user based on collected sound data obtained by collecting, at the position of the head, the measurement signal sound output from the sound source. The terminal apparatus includes a sound collection unit that is mounted on the user and used and that collects, at the position of the head, the measurement signal sound output from the sound source, and a transmission unit that transmits data collected by the sound collection unit to the control apparatus.

The "system" mentioned here denotes a logical set of a plurality of apparatuses (or functional modules that realize specific functions), and whether or not the apparatuses or the functional modules are in a single housing does not particularly matter.

Advantageous Effect of Invention

The technique disclosed in the present specification can provide the information processing apparatus, the information processing method, and the acoustic system that carry out the process for deriving the head related transfer function.

Note that the advantageous effects described in the present specification are illustrative only, and the advantageous effects of the present invention are not limited to these. In addition, the present invention may also attain additional advantageous effects other than the advantageous effects described above.

Other objects, features, and advantages of the technique disclosed in the present specification will become apparent from more detailed description based on the embodiment described later and the attached drawings.

DESCRIPTION OF EMBODIMENT

Hereinafter, an embodiment of the technique disclosed in the present specification will be described in detail with reference to the drawings.

Figure 20:
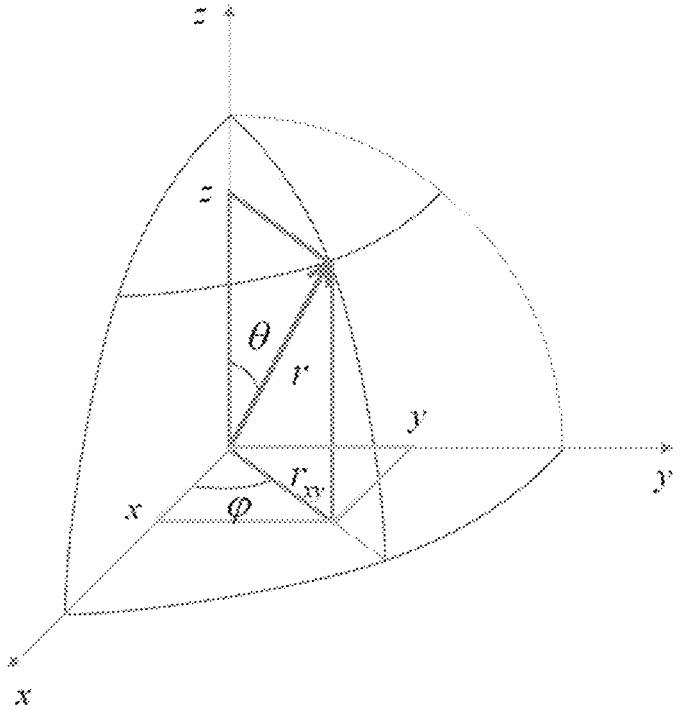
FIG. 20 is a diagram illustrating general spherical coordinates.
Figure 21:
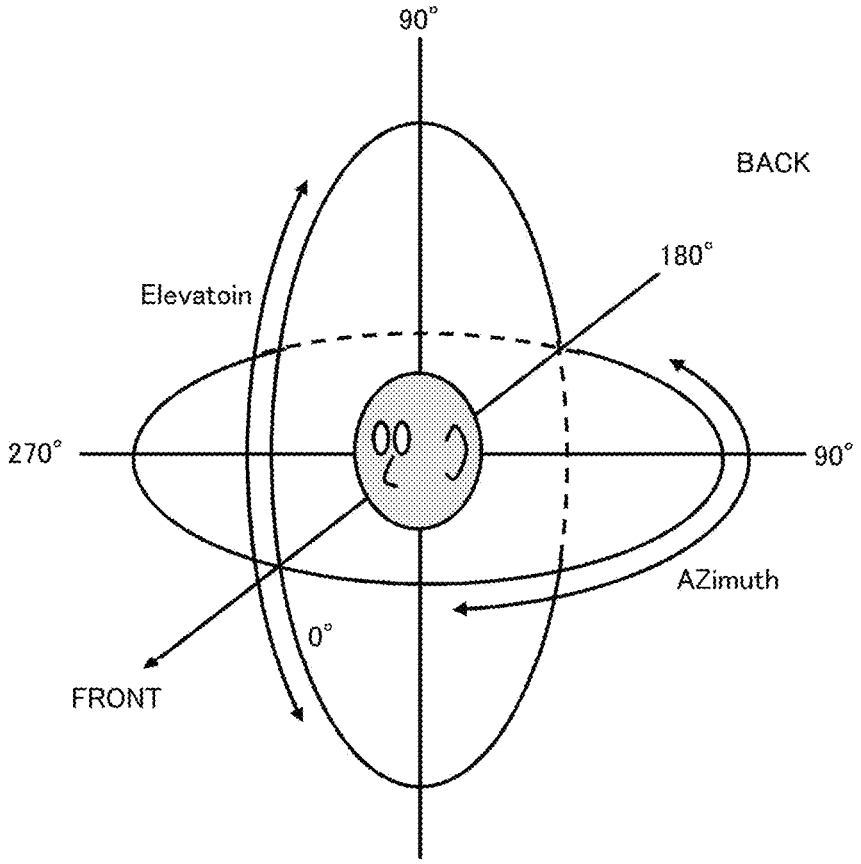
FIG. 21 is a diagram illustrating a state in which an origin of the spherical coordinates is set on the head of a subject of the HRTF.
Figure 22:
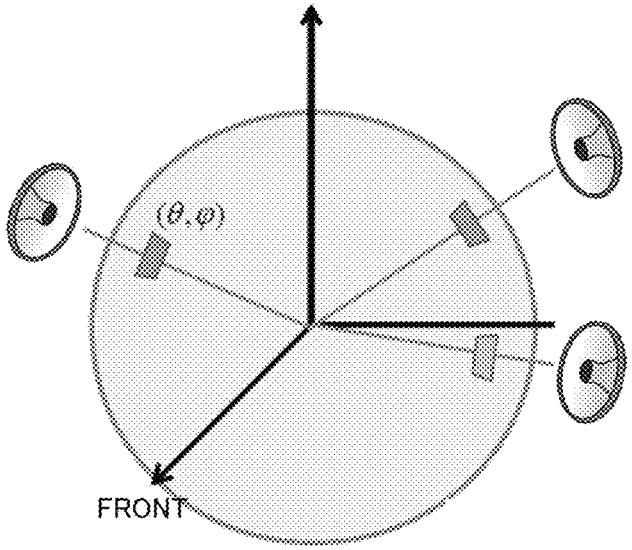
FIG. 22 is a diagram illustrating a state in which sound sources for HRTF measurement are installed at positions represented by the spherical coordinates.

First, "position," "angle," and "distance" in an HRTF measurement system disclosed in the present specification will be described. In the embodiment described below, a position of a measurement point for measuring an HRTF of a user will be expressed by general spherical coordinates. As illustrated in FIG. 20, the position in the spherical coordinates can be expressed by ($\phi$, $\theta$, r). FIG. 21 illustrates a state in which an origin of the spherical coordinates is set on the head of a subject of the HRTF. In FIG. 21, $\phi$ is defined as a horizontal direction angle (Azimuth), and $\theta$ is defined as an elevation direction angle (Elevation). As for $\phi$, the front side of the head (FRONT) is zero degrees, and the back side (BACK) is 180 degrees. Therefore, the side surface of the left ear is 90 degrees, and the side surface of the right ear is 270 degrees. As for $\theta$, the top of the head (TOP) is 90 degrees, and a plane connecting the front side and the back side of the head (reference plane) is zero degrees. By the way, a downward direction from the reference plane is a negative angle. In addition, r is defined as a distance between the head of the subject and a sound source to be localized. FIG. 22 illustrates a state in which sound sources for HRTF measurement are installed at positions represented by the spherical coordinates.

In the measurement using the speaker traverse (movement apparatus) disclosed in PTL 2, the distance r from the measurement sound source to the head is fixed, and $\phi$ and $\theta$ are changed for the measurement. When the distance r is fixed, the measurement is performed for a plurality of positions ($\phi$, $\theta$, r), and the HRTF at an optional position ($\phi'$, $\theta'$, r) that is not a measurement point can be calculated by interpolation using a technique such as spline interpolation.

The present embodiment allows measurement at a position different from the position where the position ($\phi$, $\theta$, r) is set as a measurement point. Such a system is useful in a case of measuring the HRTF in a situation in which the position is not fixed, such as when the subject moves or changes the posture in the HRTF measurement system. In a case where the position of the measurement of the head of the user is ($\phi'$, $\theta'$, r'), and the position of the set measurement point is ($\phi$, $\theta$, r), an approximate value of the HRTF is measured. In this case, interpolation calculation using a generally well-known technique can be performed to obtain the HRTF at the position ($\phi$, $\theta$, r) of the measurement point from the HRTF of the measurement point approximated by the position ($\phi'$, $\theta'$, r') and from the values of a plurality of measurement points measured at more accurate positions in the surroundings. In addition, an absolute value of a position error $d=(\phi, \theta, r)-(\phi', \theta', r')$ allowed for the position that can be approximated may be set within a certain range ($|d|<=D$), and the HRTF measurement system may be set to allow the approximate measurement within the range. In such a way, the measurement in the allowed range can be performed.

Note that the "position" in the present specification has three meanings including "position" of the measurement point described above, "position" where the user as a subject exists, and "position" of a sound source or the like for measurement or for drawing attention of the subject. It should be noted that the meaning of "position" is properly used as necessary in the HRTF measurement system described below.

Figure 1:
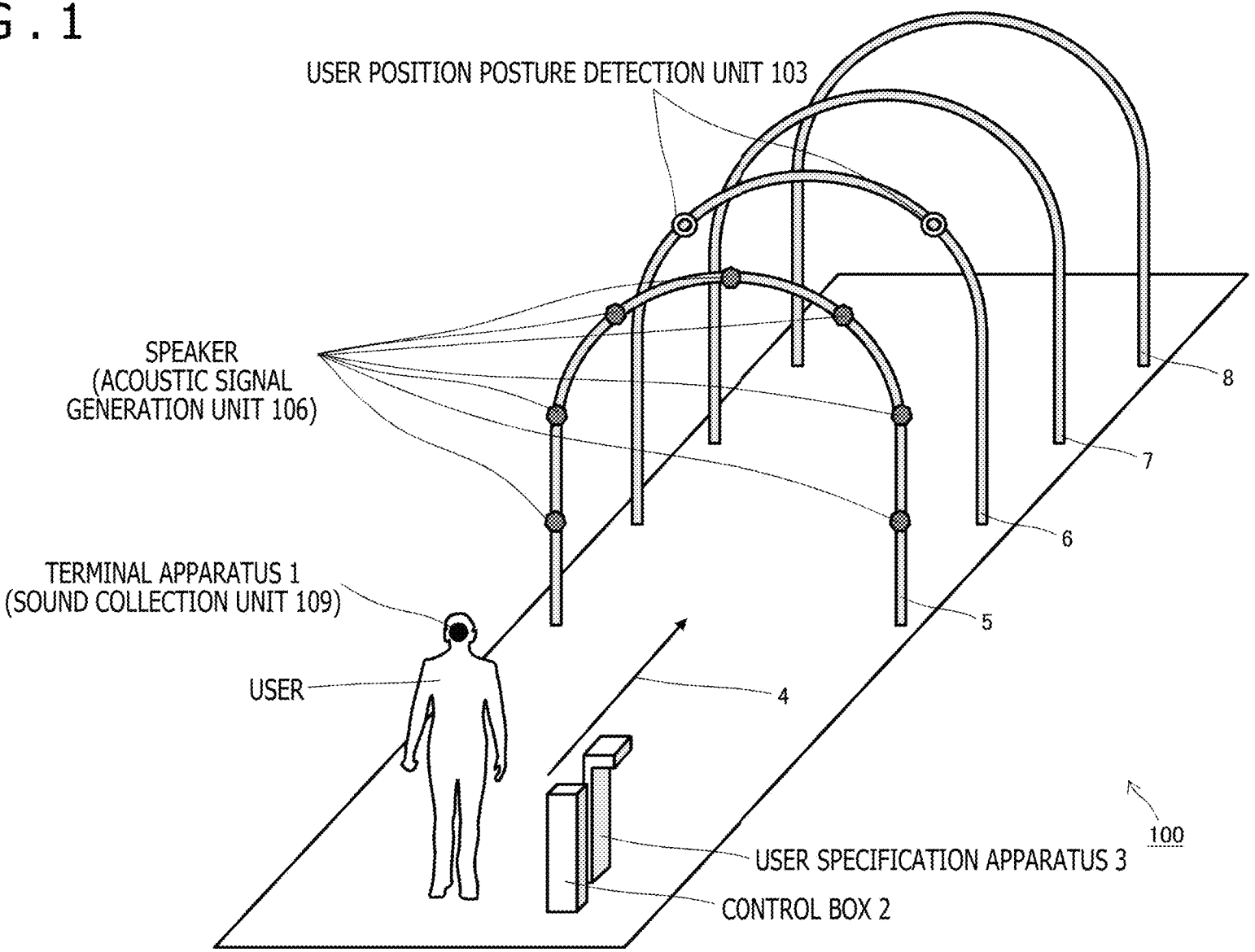
FIG. 1 is a diagram illustrating an external configuration example of an HRTF measurement system 100.
Figure 2:
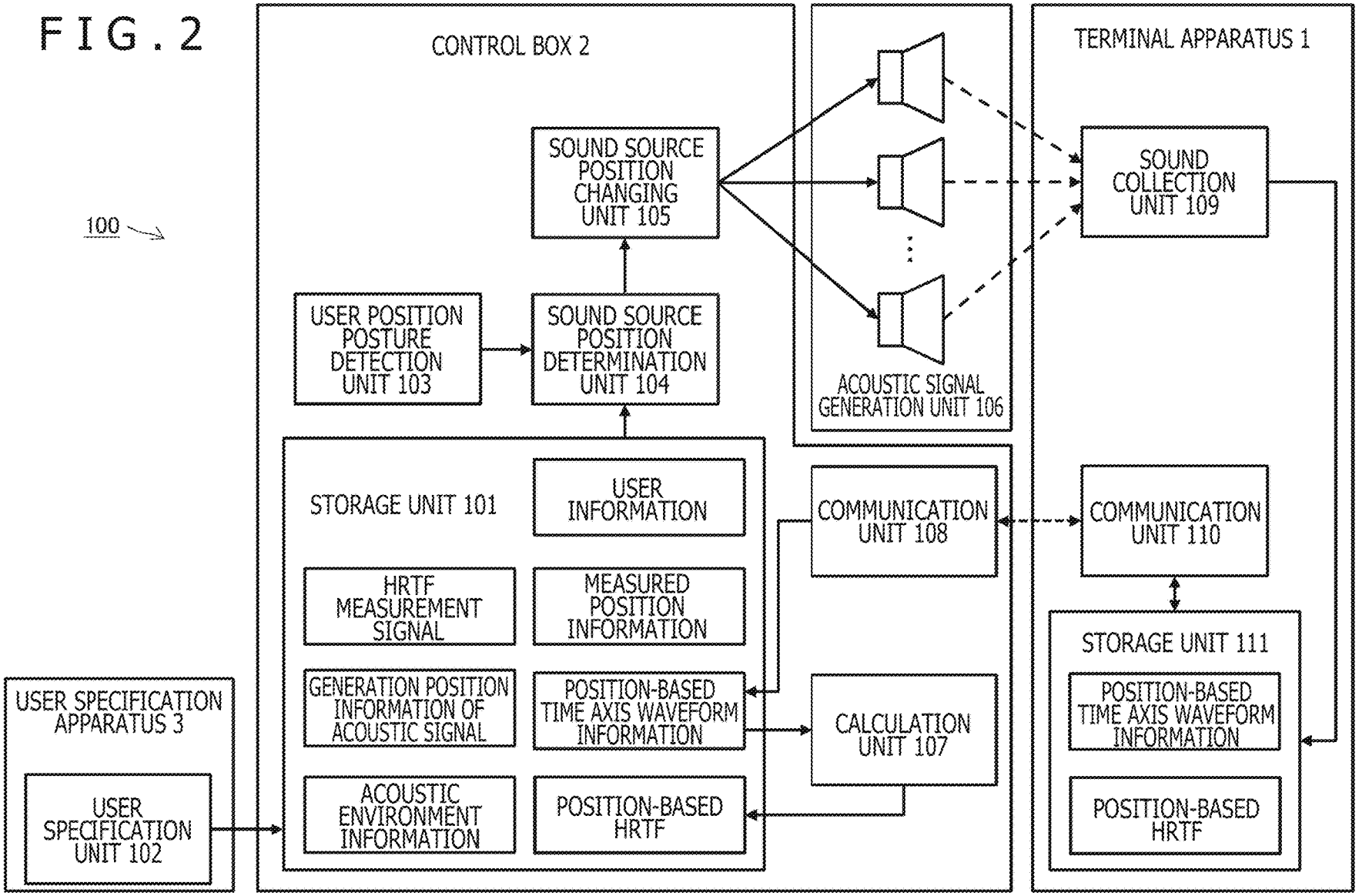
FIG. 2 is a diagram schematically illustrating a function boat configuration example of the HRFT measurement system 100.

FIG. 1 illustrates an external configuration example of an HRTF measurement system 100 in which the technique disclosed in the present specification is applied. In addition, FIG. 2 schematically illustrates a functional configuration example of the HRFT measurement system 100.

Figure 13:
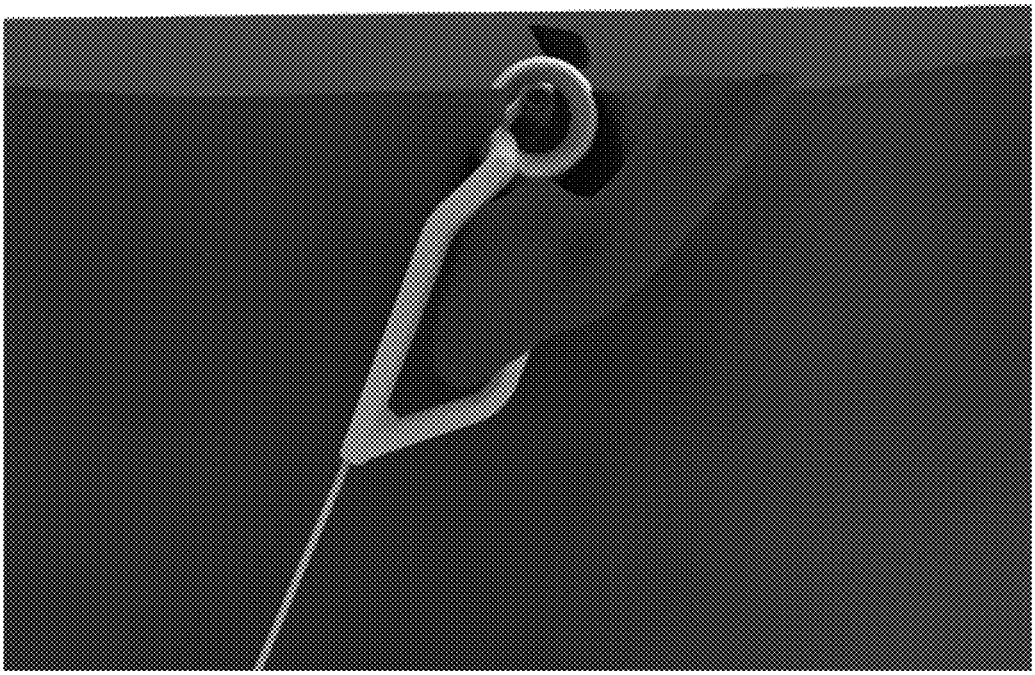
FIG. 13 is a diagram illustrating a state in which the terminal apparatus 1 illustrated in FIG. 12 is mounted on the left ear of a person (dummy head).

With reference to FIG. 1, a terminal apparatus 1 including a sound collection unit 109 is mounted on the head of the user. The structure of the terminal apparatus 1 will be described later. A structure for attaching an open-ear sound collection unit 109 to the ear of the user is provided as illustrated in FIG. 13, and the physical and mental burden of the user wearing the terminal apparatus 1 on the head is significantly small. A control box 2 and a user specification apparatus 3 are provided near the user. However, the control box 2 and the user specification apparatus 3 may not be individual housings, and constituent components of the control box 2 and the user specification apparatus 3 may be housed in a single housing. Furthermore, functional blocks inside of the control box 2 and the user specification apparatus 3 may be arranged in separate housings.

In addition, a plurality of gates 5, 6, 7, 8, . . . , each including an arch-shaped frame, is installed in a traveling direction of the user indicated by reference number 4. A plurality of speakers included in an acoustic signal generation unit 106 (described later) is installed at different places on the gate 5 in the front. In addition, a user position posture detection unit 103 (described later) is installed on the second gate 6 from the front. The acoustic signal generation unit 106 and the user position posture detection unit 103 may be alternately installed on the third and following gates 7, 8, . . . .

The user may not go straight in the traveling direction 4 in a constant posture. The user may meander or may be crouched, and the relative position and the posture with respect to the acoustic signal generation unit 106 may vary.

With reference to FIG. 2, the HRTF measurement system 100 includes a storage unit 101, a user specification unit 102, the user position posture detection unit 103, a sound source position determination unit 104, a sound source position changing unit 105, the acoustic signal generation unit 106, a calculation unit 107, and a communication unit 108. In addition, the HRTF measurement system 100 includes the sound collection unit 109, a communication unit 110, and a storage unit 111 on the side of the user as a measurement target of the HRTF.

The storage unit 101, the user position posture detection unit 103, the sound source position determination unit 104, the sound source position changing unit 105, the acoustic signal generation unit 106, the calculation unit 107, and the communication unit 108 are housed in the control box 2. In addition, the user specification unit 102 is housed in the user specification apparatus 3, and the user specification apparatus 3 is externally connected to the control box 2. In addition, the sound collection unit 109, the communication unit 110, and the storage unit 111 are housed in the terminal apparatus 1 mounted on the head of the user as a measurement target of the HRTF. Furthermore, the communication unit 108 on the control box 2 side and the communication unit 110 on the terminal apparatus 1 side are connected to each other through, for example, wireless communication.

In a case where the terminal apparatus 1 and the control box 2 communicate through a radio wave, each of the communication unit 108 and the communication unit 110 is equipped with an antenna (not illustrated). However, optical communication, such as infrared rays, can be used between the terminal apparatus 1 and the control box 2 in an environment with a little influence of interference. In addition, although the terminal apparatus 1 is basically battery-driven, the terminal apparatus 1 may be driven by a commercial power supply.

The user specification unit 102 includes a device that uniquely determines the current measurement target of HRTF. The user specification unit 102 includes, for example, an apparatus that can read (or identify) an ID card with IC, a magnetic card, a piece of paper on which a one-dimensional or two-dimensional barcode is printed, a smartphone in which an application for specifying the user is executed, a watch-type device including a wireless tag, a bracelet-type device, and the like. In addition, the user specification unit 102 may be a device that specifies the user by reasoning biometric information, such as fingerprint impression and vein authentication. In addition, the user specification unit 102 may specify the user based on a recognition result of a two-dimensional image or three-dimensional data of the user acquired by a camera or a 3D scanner. The user is managed by a user identifier (ID) registered in advance. In this case, the user as a temporary user may perform the first measurement of the HRFT, and a specific user ID and the measured HRTF may be associated after the measurement.

A process for measuring the HRTF of each user specified by the user specification unit 102 is executed in the control box 2.

HRTF measurement data of each user specified by the user specification unit 102, data necessary for the HRTF measurement process, and the like are stored in the storage unit 101. A mapping table or the like of users and data management storage areas of the users can be prepared to manage the data. Note that in the following description, one piece of data will be described for each user. Ideally, it is desirable to collect the HRTF data of each of the left ear and the right ear for each user. To do so, the HRTF data of each user is sorted into data for left ear and data for right ear and managed in the storage unit 101.

For each user, the HRTFs need to be measured at a plurality of measurement points in the spherical coordinates. In other words, the measurement points of HRTFs exist all around the user, and a set of HRTFs measured at all the measurement points is the HRTF data of the user. In the HRTF measurement system 100 according to the present embodiment, the user position posture detection unit 103 uses a camera, a distance sensor, or the like to measure the position and the posture of the head of the user (direction of head (may be direction of face or part of face (such as nose, eyes, and mouth), which similarly applies hereinafter)), and the sound source position determination unit 104 uses the measurement result to determine whether or not there is a sound source at a position where the HRTF needs to be measured for the user next (that is, whether or not the measurement is possible at the position that requires the measurement of the HRTF). To efficiently measure the HRTF data of the user at a plurality of measurement points in a short time, the sound source position determination unit 104 needs to extract the position of the sound source for measuring the HRTF next from position information of unmeasured measurement points to sequentially determine the sound source at the position for measuring the HRTF at the extracted measurement point so that the HRTF at an already measured position is not repeatedly measured. However, the measurement points for which quality determination of measurement data described later or quality determination of calculated HRTF has failed may be recorded as "unmeasured" or "remeasurement," and the measurement of the HRTF may be repeated later for the measurement points.

More specifically, there is also reflected sound and reverberation unique to each acoustic environment, and it is preferable to acquire the HRTF data of each user for each acoustic environment. In the present embodiment, it is assumed that the HRTF data of each user is managed in association with the acoustic environment information in the storage unit 101. In addition, the terminal apparatus 1 or the control box 2 may be equipped with a sensor for sensing the acoustic environment during the HRTF measurement, or the user may instruct and input the acoustic environment at the time of the measurement of the HRTF through a UI (User Interface). As an example of acquiring and managing the HRTF data of each user for each acoustic environment, it is sufficient if the HRTF data is stored and managed for each combination of the environment information identifier of the acoustic environment information and the user identifier (ID) of the user information in FIG. 2.

The user position posture detection unit 103 measures at which coordinates in the HRTF measurement system 100 the position of the head of the user specified by the user specification unit 102 exists and in which direction the user is facing (that is, posture information of user) in the spherical coordinates around the coordinates in a case where the head of the user is placed at the coordinate position. The user position posture detection unit 103 includes, for example, one or more cameras, one of a TOF (Time Of Flight) sensor, a laser measurement device (such as LiDAR), an ultrasonic sensor, or the like, or a combination of a plurality of sensors. Therefore, the HRTF measurement system 100 can measure the distance r from each speaker included in the acoustic signal generation unit 106 to the head of the user. In the example illustrated in FIG. 1, a stereophonic sensor for user position posture detection is provided on the second gate 6 from the front in the traveling direction 4 of the user (described above). Note that although not illustrated, the user position posture detection unit 103 can also use a skeleton model analysis unit using an image recognition technique to recognize the direction of the head or use an inference unit using an artificial intelligence technique (technique such as deep neural network) to predict the action of the user to thereby provide, as part of the posture information, information indicating whether or not the position of the head is stable in a certain time period. In such a way, the measurement of the HRTF can be more stable.

The acoustic signal generation unit 106 includes one or more speakers and provides sound sources that generate signal sound for HRTF measurement. In addition, the sound sources can also be used as sound sources that generate signal sound as information viewed by the user (or information prompting the user to view) as described later. In the example illustrated in FIG. 1, a plurality of speakers included in the acoustic signal generation unit 106 is installed at different places on the gate 5 in the front in the traveling direction 4 of the user (described above).

The sound source position determination unit 104 selects a position ($\phi$, $\theta$, r) of the HRTF to be measured next for the user as the current measurement target of HRTF (or the user currently specified by the user specification unit 102) from the relative position of the position and posture information of the head of the user obtained by the user position posture detection unit 103 and the acoustic signal generation unit 106 and sequentially determines the sound source (speaker) at the position for measuring the TRTF of the selected position. It is preferable in terms of the efficiency of processing that each sound source hold an identifier (ID), and the sound source be controlled based on the ID after the sound source is determined based on the position. Furthermore, in the case where the stability information of the posture is provided as posture information as described above, the sound source position may be determined when the posture is stable. In such a way, the measurement of the HRTF can be more stable.

The sound source position changing unit 105 controls the acoustic signal generation unit 106 to generate signal sound for HRTF measurement from the position of the sound source determined by the sound source position determination unit 104. In the present embodiment, the acoustic signal generation unit 106 includes a plurality of speakers arranged at different positions as illustrated in FIG. 1. The sound source position changing unit 105 designates the ID of the sound source and controls the output switch of each speaker to generate the signal sound for HRTF measurement from the speaker as a sound source at the position determined by the sound source position determination unit 104. Alternatively, in a case where there is no speaker as a sound source at the strict position corresponding to the position ($\phi$, $\theta$, r) determined by the sound source position determination unit 104, signal sound for HRTF measurement may be generated from a speaker at ($\phi'$, $\theta'$, r') near the position. Furthermore, the calculation unit 107 in a later stage may interpolate the HRTF at a desirable position based on data obtained by collecting signal sound output from two or more positions near the desirable position. Furthermore, in a case where there is a measurement point not finished with the measurement of the HRTF due to stationary environmental noise of the surroundings or sudden noise, the interpolation may also be performed based on HRTF data at a surrounding measurement point normally finished with the measurement. In the case where there is no speaker as a sound source at the strict position, the fact that the measurement is approximate measurement and the approximated position can be recorded in an HRTF measurement data table stored for each user, and the table can be used for the interpolation calculation. In addition, "approximate measurement" can be recorded in the HRTF data measured at the approximated position, and the HRTF can be remeasured later. Furthermore, in the case of the approximate measurement, information, such as measured approximate position and measurement accuracy, can be recorded together, and the HRTF measurement system 100 can later use the information in determining the necessity of remeasurement.

The sound collection unit 109 includes a microphone that converts a sound wave into an electrical signal. The sound collection unit 109 is housed in the terminal apparatus 1 mounted on the head of the user as a measurement target of the HRTF and collects signal sound for HRTF measurement emitted from the acoustic signal generation unit 106. Note that quality determination may be performed to determine whether or not there is an abnormality in the acoustic signal collected by the sound collection unit 109. Furthermore, the data measured by the sound collection unit 109 is temporarily stored in the storage unit 111 and transmitted from the terminal apparatus 1 to the control box 2 side through the communication unit 110.

The data measured by the sound collection unit 109 is time axis waveform information obtained by collecting the HRTF measurement signal emitted from the sound source at the position determined by the sound source position determination unit 104. On the control box 2 side, once the data measured by the sound collection unit 109 is received through the communication unit 108, the data is stored in the storage unit 101. Furthermore, the calculation unit 107 calculates the HRTF at the position of the sound source from the time axis waveform information measured for each position of the sound source and causes the storage unit 101 to store the HRTF. When the calculation unit 107 calculates the HRTF, quality determination is performed to determine whether or not the data measured by the sound collection unit 109 is correctly measured (or the quality determination may be performed in causing the storage unit 101 to store the HRTF). In addition, quality determination of the HRTF calculated by the calculation unit 107 is also performed. Note that the calculation unit 107 may calculate the HRTF in parallel with the sound collection of the HRTF measurement signal or may calculate the HRTF when some amount of unprocessed collected sound data is accumulated in the storage unit 101 or at optional timing. Although not illustrated, in a case where the terminal apparatus 1 further includes a position detection sensor such as a GPS (Global Positioning System), communication between the communication unit 110 of the terminal apparatus 1 and the communication unit 108 of the control box 2 can be used to transmit the information of the position detection sensor to the control box 2 to allow the control box 2 to use the information to measure the distance to the position of the head of the user. In such a way, there is an advantageous effect that the information of distance to the head of the user can be obtained even in a case where there is no distance measurement apparatus fixed to the HRTF measurement system 100.

Note that the process and the data management in at least part of the functional modules in the control box 2 illustrated in FIG. 2 may be carried out on a cloud. Here, the "cloud" in the present specification generally denotes cloud computing. The cloud provides a computing service through a network such as the Internet. In a case where computing is performed at a position closer to the information processing apparatus that receives the service in the network, the computing is also called edge computing, fog computing, or the like. There is also a case in which the cloud in the present specification is understood to denote a network environment or a network system for cloud computing (resources for computing (including processor, memory, wireless or wired network connection equipment, and the like)). Furthermore, there is also a case in which the cloud is understood to denote a service or a provider provided in a form of a cloud.

Figure 3:
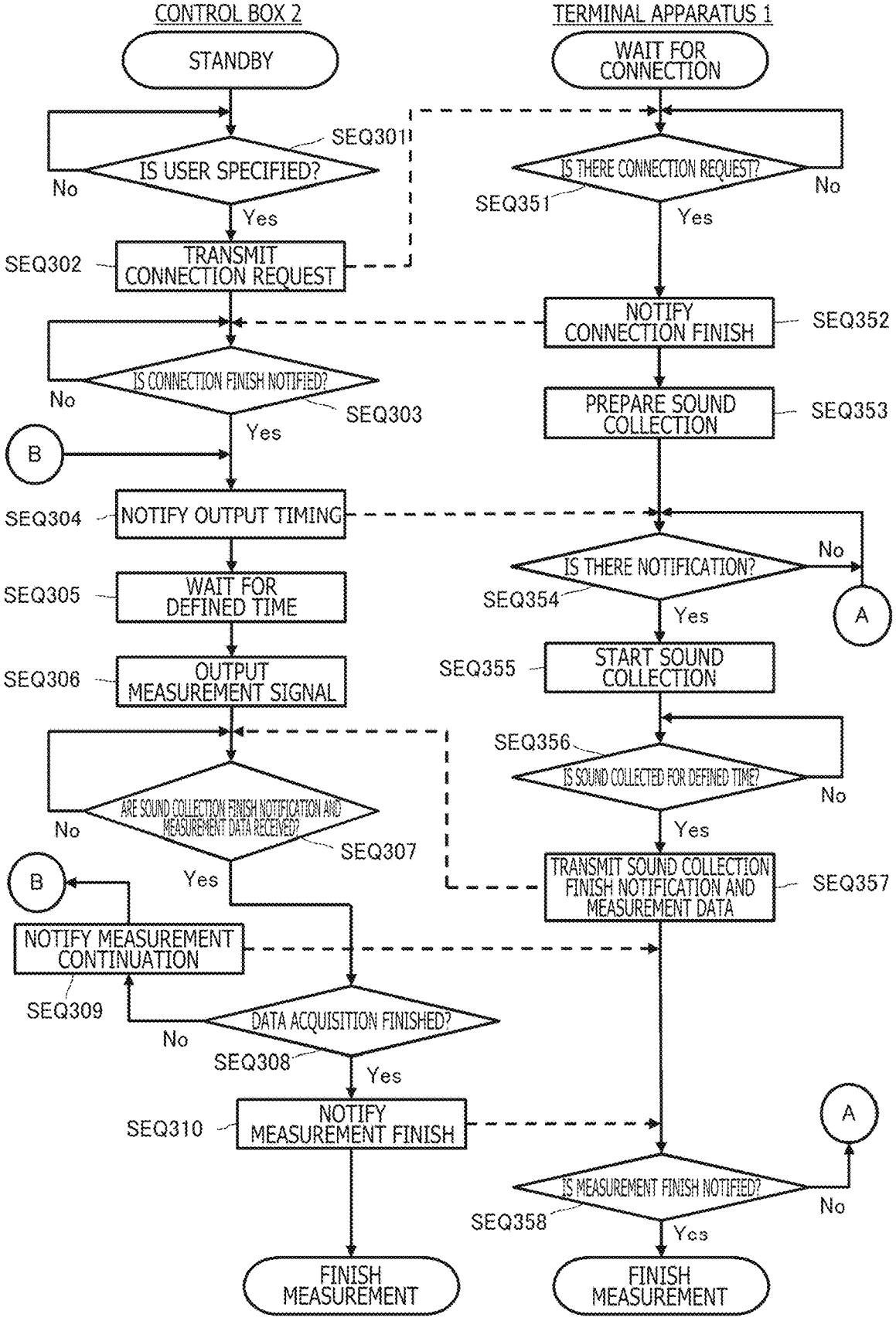
FIG. 3 is a diagram illustrating a basic process sequence example executed between a control box 2 and a terminal apparatus 1 in measuring an HRTF.

FIG. 3 illustrates a basic process sequence example executed between the control box 2 and the terminal apparatus 1 when the HRTF measurement system 100 according to the present embodiment measures the HRTF.

The control box 2 side waits until the user specification unit 102 of the user specification apparatus 3 specifies the user (No in SEQ301). Here, it is assumed that the user is wearing the terminal apparatus 1 on the head.

Furthermore, once the user specification unit 102 specifies the user (Yes in SEQ301), the control box 2 transmits a connection request to the terminal apparatus 1 (SEQ302) and waits until a connection finish notification is received from the terminal apparatus 1 (No in SEQ303).

On other hand, the terminal apparatus 1 side waits until the connection request is received from the control box 2 (No in SEQ351). Furthermore, once the terminal apparatus 1 receives the connection request from the control box 2 (Yes in SEQ351), the terminal apparatus 1 executes a process of connecting to the control box 2 and then returns a connection finish notification to the control box 2 (SEQ352). Subsequently, the terminal apparatus 1 prepares the sound collection of the HRTF measurement signal to be executed by the sound collection unit 109 (SEQ353) and waits for a notification of output timing of the HRTF measurement signal from the control box 2 side (No in SEQ354).

Once the connection finish is received from the terminal apparatus 1 (Yes in SEQ303), the control box 2 notifies the terminal apparatus 1 of the output timing of the HRTF measurement signal (SEQ304). Furthermore, the control box 2 waits for a defined time (SEQ305) and outputs the HRTF measurement signal from the acoustic signal generation unit 106 (SEQ306). Specifically, the HRTF measurement signal is output from the sound source (speaker) corresponding to the sound source position changed by the sound source position changing unit 105 according to the determination by the sound source position determination unit 104. Subsequently, the control box 2 waits to receive the sound collection finish notification and the measurement data from the terminal apparatus 1 side (No in SEQ307).

In response to the notification of the output timing of the HRTF measurement signal from the control box 2 (Yes in SEQ354), the terminal apparatus 1 starts the sound collection process of the HRTF measurement signal (SEQ355). Furthermore, once the terminal apparatus 1 collects the HRTF measurement signal for a defined time (Yes in SEQ356), the terminal apparatus 1 transmits the sound collection finish notification and the measurement data to the control box 2 (SEQ357).

Once the control box 2 receives the sound collection finish notification and the measurement data from the terminal apparatus 1 side (Yes in SEQ307), the control box 2 checks whether or not the acquisition of the measurement data necessary and sufficient for calculating the HRTF of the user specified in SEQ351 is finished (SEQ308). Here, the control box 2 also performs the quality determination to determine whether or not there is an abnormality in the acoustic signal collected by the sound collection unit 109 on the terminal apparatus 1 side.

In a case where the acquisition of the measurement data necessary and sufficient for calculating the HRTF is not finished yet (No in SEQ308), the control box 2 transmits a measurement continuation notification to the terminal apparatus (SEQ309) and returns to SEQ304 to repeatedly carry out the notification of the output timing of the HRTF measurement signal and the transmission process of the HRTF measurement signal.

Furthermore, once the acquisition of the measurement data necessary and sufficient for calculating the HRTF is finished (Yes in SEQ308), the control box 2 transmits a measurement finish notification to the terminal apparatus 1 (SEQ310) and finishes the process for the HRTF measurement.

In a case where the measurement continuation notification is received from the control box 2 (No in SEQ358) after the transmission of the sound collection finish notification and the measurement data (SEQ357), the terminal apparatus 1 returns to SEQ354 to wait for the notification of the output timing of the HRTF measurement signal from the control box 2 side and repeatedly carries out the sound collection process of the HRTF measurement signal and the transmission of the sound collection finish notification and the measurement data to the control box 2.

Furthermore, in a case where the measurement finish notification is received from the control box 2 (Yes in SEQ358), the terminal apparatus 1 finishes the process for the HRTF measurement.

Figure 4:
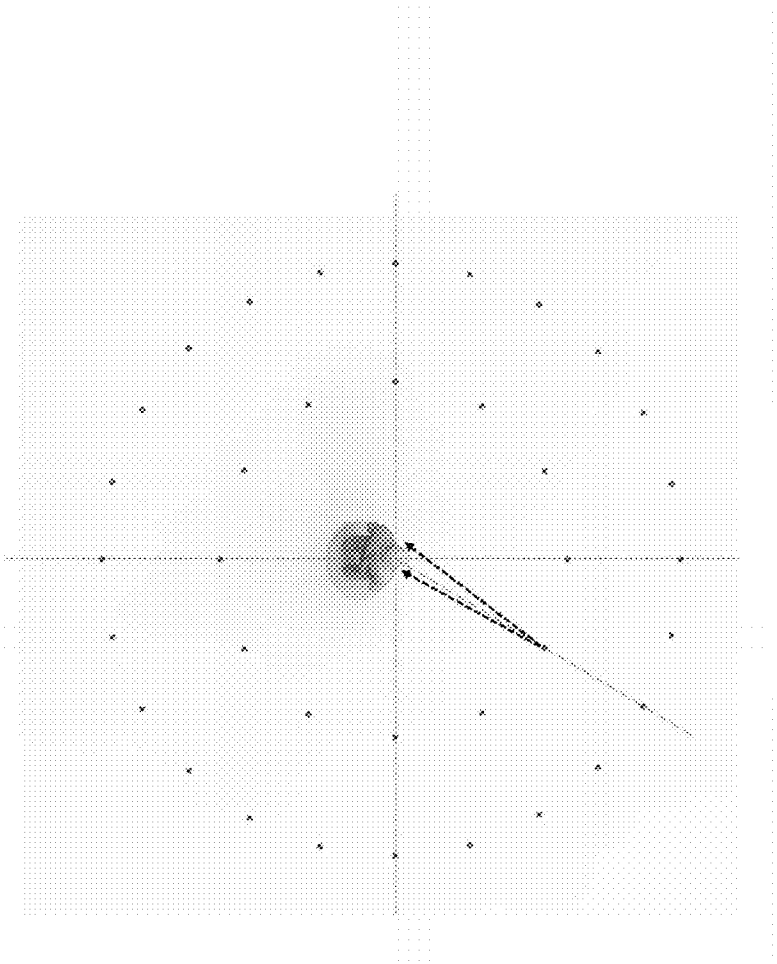
FIG. 4 is a diagram illustrating an example of a sound source position of a head horizontal plane of HRTF data.
Figure 5:
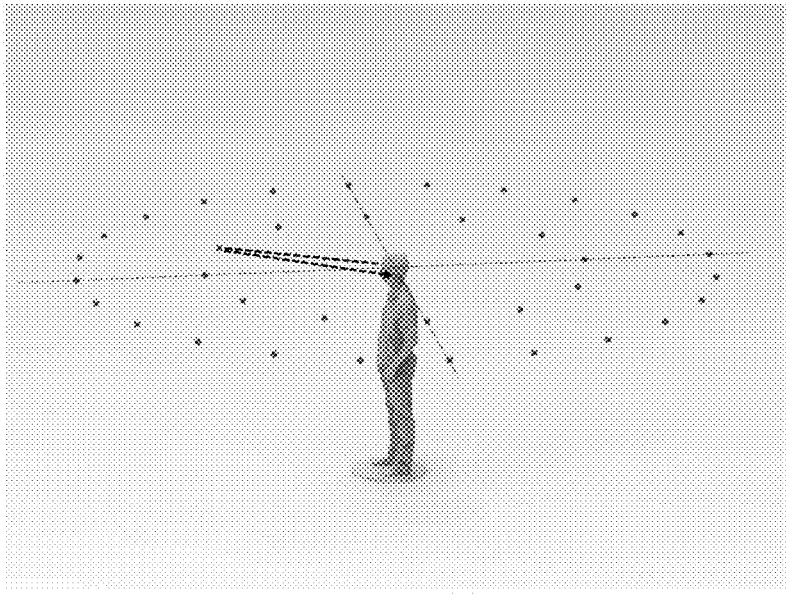
FIG. 5 is a diagram illustrating an example of the sound source position of the head horizontal plane of the HRTF data.

FIGS. 4 and 5 illustrate an example of the sound source position of a head horizontal plane (that is, $\theta$=zero degrees in spherical coordinates) of the HRTF data to be measured. In the example illustrated in FIGS. 4 and 5, the measurement point is arranged every 30 degrees on a circumference with a radius of 150 cm in the spherical coordinates around the head of the user in the head horizontal plane of the user, and the measurement point is arranged every 15 degrees on a circumference with a radium of 250 cm around the head of the user. Furthermore, in FIGS. 4 and 5, dotted lines illustrate an example of the transfer function from the sound source position at the distance of 150 cm in the direction of an angle of 30 degrees to the right from the front of the user to the left and right ears of the user. In other words, the positions of the measurement points are defined by (0, $\phi1+\Delta\phi1$, 250 cm), where $\phi1$=zero degrees and $\Delta\phi1$=15 degrees, and (0, $\phi2+\Delta\phi2$, 150 cm), where $\phi2$=zero degrees and $\Delta\phi2$=30 degrees, in the spherical coordinates.

Figure 6:
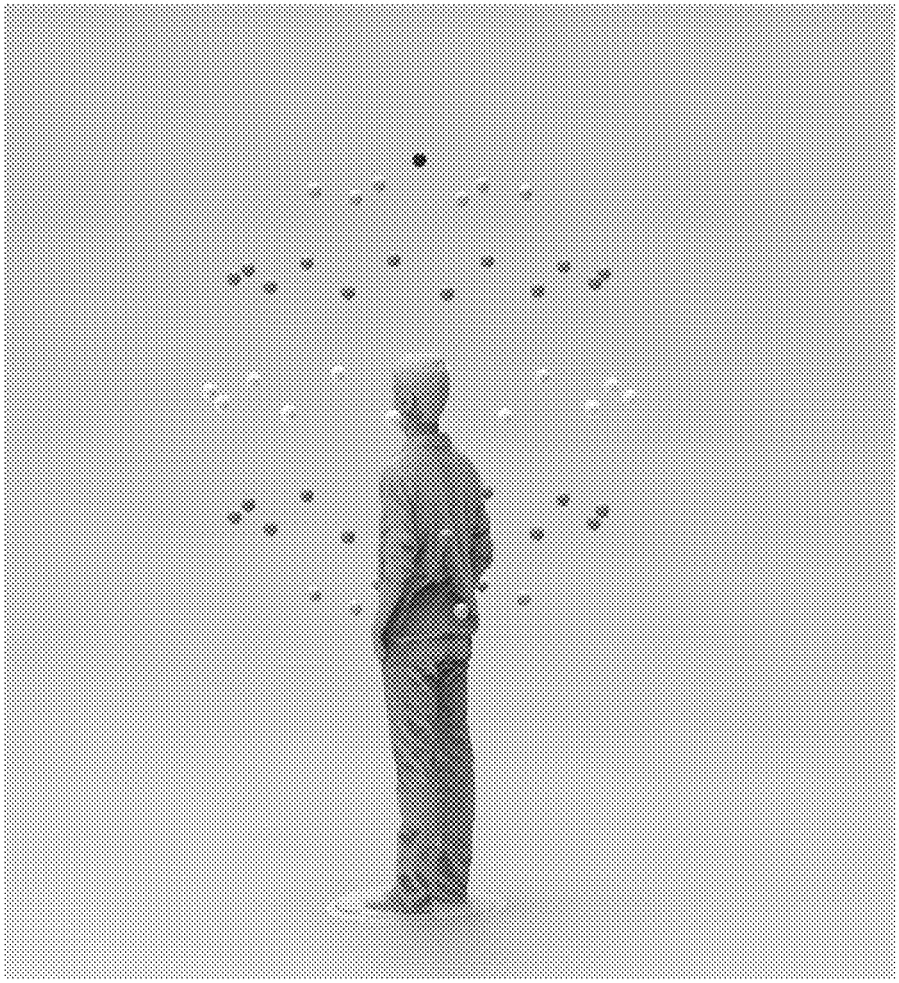
FIG. 6 is a diagram illustrating an example of arranging 49 measurement points on a spherical surface at a radius of 75 cm from a head of a user.

Basically, the sound source position can be set at the position of the measurement point of the HRTF, and the HRTF of the measurement point can be obtained based on the collected sound data of the HRTF measurement signal output from the sound source position. The required number and density (spatial distribution) of measurement points vary depending on the usage or the like of the HRTF. In addition, the number of sound source positions, that is, measurement points, varies according to the required accuracy of HRTF data. FIG. 6 illustrates an example of arranging 49 measurement points on a spherical surface at a radius of 75 cm from the head of the user.

The HRTFs of two or more measurement points cannot be measured at the same time exactly, and therefore, the HRTFs need to be sequentially measured for each measurement point. According to the configuration of the HRTF measurement system 100 illustrated in FIG. 1, in a period in which the user provided with the terminal apparatus 1 on the head goes through the gates 5, 6, 7, 8, . . . on foot, the sound source position determination unit 104 sequentially determines the position of the sound source for measuring the HRTF next without overlapping the sound source position at the position where the HRTF is already measured, and the sound source position changing unit 105 causes one of the plurality of speakers arranged on the gates 5, . . . to generate the signal sound for HRTF measurement to set the position of the sound source determined by the sound source position determination unit 104 as the next sound source position.

In the terminal apparatus 1, the sound collection unit 109 collects the sound of the HRTF measurement signal and transmits the collected sound data to the control box 2 through the communication unit 110. The calculation unit 107 calculates the HRTF at the corresponding measurement point based on the received collected sound data and causes the storage unit 101 to store the HRTF.

Figure 7:
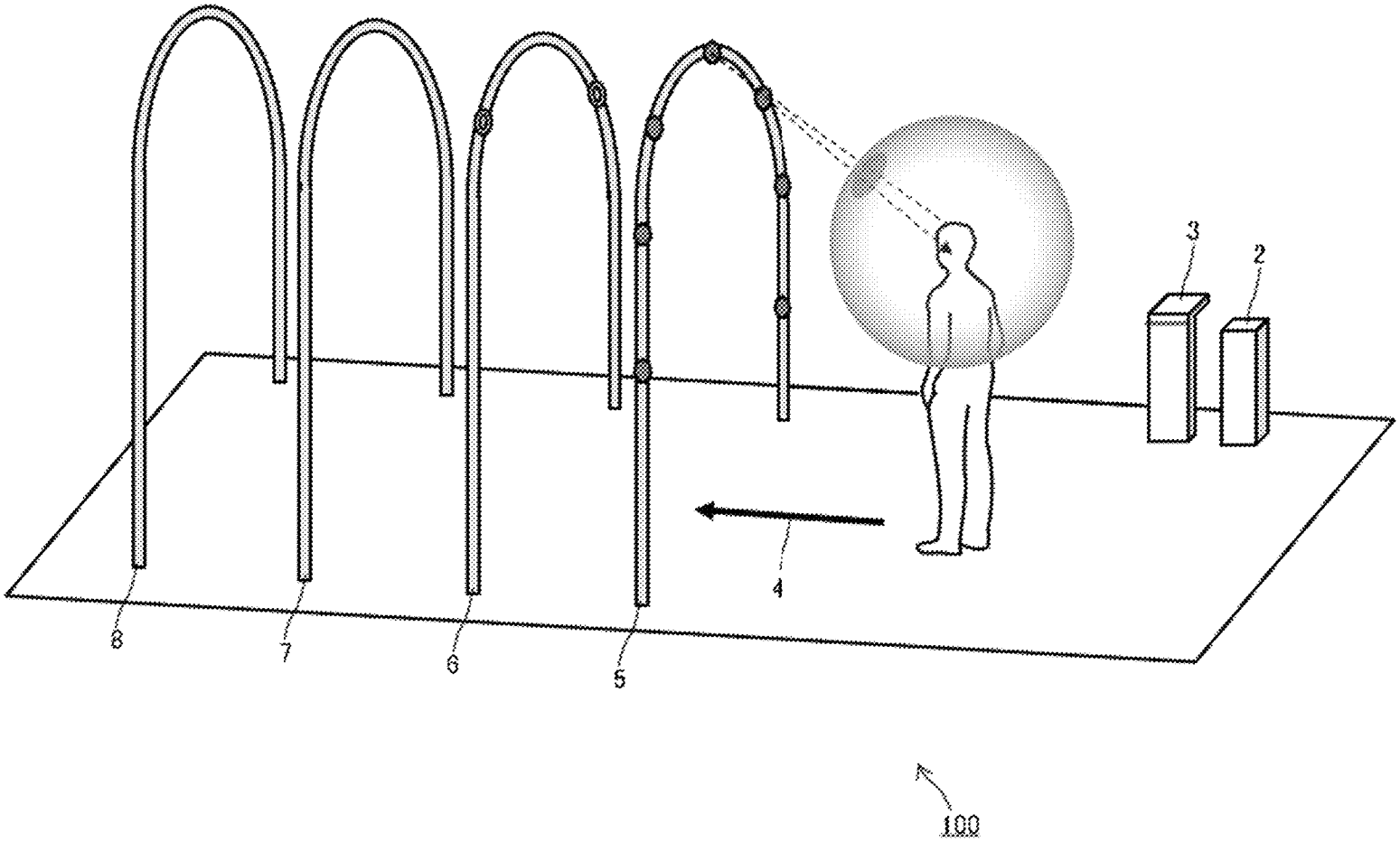
FIG. 7 is a diagram illustrating a state in which the user goes through gates 5, 6, 7, 8, . . . on foot (state of measuring the HRTFs all around the user).
Figure 8:
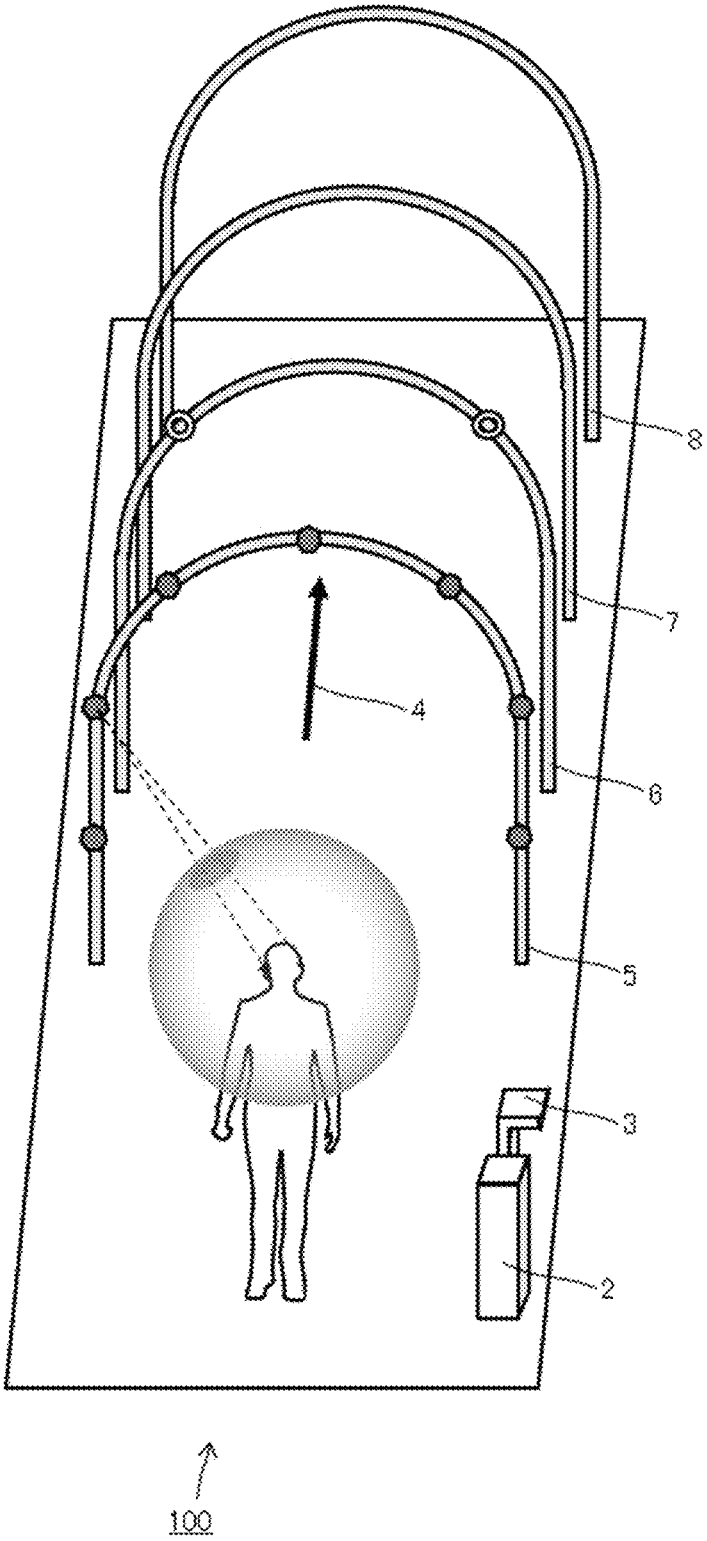
FIG. 8 is a diagram illustrating the state in which the user goes through the gates 5, 6, 7, 8, . . . on foot (state of measuring the HRTFs all around the user).

FIGS. 7 and 8 illustrate a state in which the user goes through the gates 5, 6, 7, 8, . . . on foot. While the user walks in the direction indicated by the arrow 4, the relative position between the head of the user and each of the plurality of speakers arranged on the gate 5 changes every moment. Therefore, even if there are measurement points of HRTF all around the user, it is expected that one of the plurality of speakers arranged on the gates 5, . . . matches the position of the measurement point of the HRTF at some time while the user walks in the direction indicated by the arrow 4.

For the current position and posture of the head of the user, the sound source position determination unit 104 determines, each time, the sound source position not overlapping the already measured measurement points. Furthermore, the sound source position changing unit 105 selects the speaker matching the sound source position sequentially determined according to the movement of the user and causes the speaker to output the HRTF measurement signal. In such a way, the sound collection at the measurement point and the measurement of the HRTF are carried out.

Therefore, the HRTF can be efficiently measured at the measurement points all around the user while the user goes through the gates 5, 6, 7, 8, . . . on foot. Note that in the case where the speaker is not arranged at the sound source position strictly matching the position of the measurement point, the HRTF at the desirable position may be interpolated based on the data obtained by collecting the signal sound output from two or more positions near the position of the measurement point. Furthermore, in the case where there is a measurement point not finished with the measurement of the HRTF due to stationary environmental noise of the surroundings or sudden noise, the interpolation may also be performed based on the HRTF data of the surrounding measurement point normally finished with the measurement.

It is preferable that the sound source position determination unit 104 uniformly select the measurement points from the entire circumference to, for example, completely measure the head related transfer functions all around the user. Alternatively, the priority of the HRTF measurement may be set in advance for each measurement point, and the sound source position determination unit 104 may determine the next measurement point with a higher priority among the measurement points not overlapping the already measured measurement points. Even in a case where, for example, the HRTFs of all of the measurement points cannot be acquired while the user passes through the gates 5, 6, 7, 8, . . . just once, the HRTFs of the measurement points with higher priorities can be acquired early with a small number of passes.

By the way, the resolution of the sound source position of a human is high in the direction of the median plane (median sagittal plane), followed by the downward direction. On the other hand, the resolution is relatively low in the left and right directions. The reason that the resolution is high in the median plane direction is also based on the fact that how the sound from the sound source in the median plane direction is heard varies between the left ear and the right ear due to the difference between the shapes of the left and right auricles of humans. Therefore, a high priority may be allocated to a measurement point close to the median plane direction.

The HRTF measurement system 100 with the functional configuration illustrated in FIG. 2 measures the HRTFs of a large number of measurement points of the user according to the process sequence as illustrated in FIG. 3. However, equipment including large-scale structures, such as the plurality of gates 5, 6, 7, 8, . . . as illustrated in FIG. 1, is not always necessary for the measurement.

Figure 9:
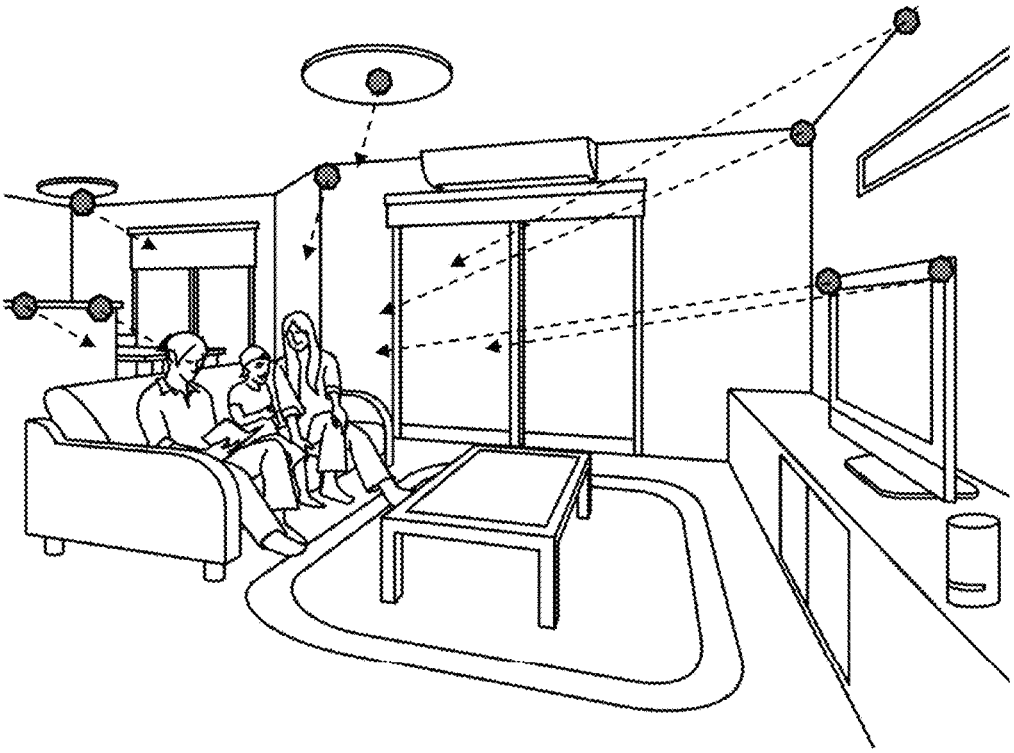
FIG. 9 is a diagram illustrating an example of providing the HRTF measurement system 100 in a living room.

For example, as illustrated in FIG. 9, a plurality of speakers as the acoustic signal generation unit 106 can be arranged at various locations in a living room of a general household (places indicated by gray polygons in FIG. 9 are positions where the speakers are arranged), and the HRTF measurement signals can be sequentially output from the speakers. In such a way, the HRTF measurement system 100 with the functional configuration illustrated in FIG. 2 can be used to measure the HRTF at each position of the user. Although three people, parents and a son of the parents, present in the living room illustrated in FIG. 9, the user specification unit 102 specifies one of the three people as the measurement target of the HRTF.

The user position posture detection unit 103 measures at which coordinates in the HRTF measurement system 100 the position of the head of the user specified by the user specification unit 102 exists and in which direction the user is facing (that is, posture information of user) in the spherical coordinates around the coordinates. The position measurement allows the HRTF measurement system 100 to measure the distance r from each speaker to the head of the user. The sound source position determination unit 104 determines the position ($\phi$, $\theta$, r) of the sound source for measuring the HRTF next, from the relative position between the position and posture information of the head of the user obtained by the user position posture detection unit 103 and each speaker. In this case, the sound source position determination unit 104 may determine the next measurement point without overlapping the already measured measurement points and may determine the next measurement point with a higher priority. Furthermore, the sound source position changing unit 105 causes one of the speakers to output the HRTF measurement signal to generate the signal sound for HRTF measurement from the position of the sound source determined by the sound source position determination unit 104. The subsequent sound collection process of the HRTF measurement signal and the calculation process of the HRTF based on the collected sound data are carried out according to the process sequence illustrated in FIG. 3 as in the case of using the equipment illustrated in FIG. 1.

Although the user (one of the three people, the parents and the son) as a measurement target of the HRTF sits on the sofa in FIG. 9, the user may not remain stationary, and the user is expected to move around in the living room soon. The user position posture detection unit 103 measures, every moment, the position and the posture of the head of the user moving around in the living room. The sound source position determination unit 104 determines, each time, the sound source position not overlapping the already measured measurement points, for the current position and posture of the head of the user. Furthermore, the sound source position changing unit 105 selects the speaker matching (or approximate to) the sound source position sequentially determined according to the movement of the user and causes the speaker to output the HRTF measurement signal to carry out the sound collection at the measurement point and the measurement of the HRTF.

Therefore, in the example illustrated in FIG. 9, the sound collection of the HRTF measurement signal and the measurement of the HRTF are steadily carried out in the background at all of the measurement points while the user lives an everyday life in the living room, and the HRTF data of the user can be acquired. In a case where a plurality of users presents in the living room, the HRTF data can be acquired for each user. In addition, the HRTF measurements of the users can also be performed in parallel in time division. The equipment as illustrated in FIG. 1 is not necessary for the HRTF measurement, and the user does not have to perform a special operation for the HRTF measurement, such as passing under the gates 5, 6, 7, 8, . . . . In addition, a large-scale apparatus such as a speaker traverse (movement apparatus) (see PTL 2) is not necessary. There is no physical and mental burden for the user, and the measurement of the HRTF can be advanced without the user noticing the measurement.

Figure 10:
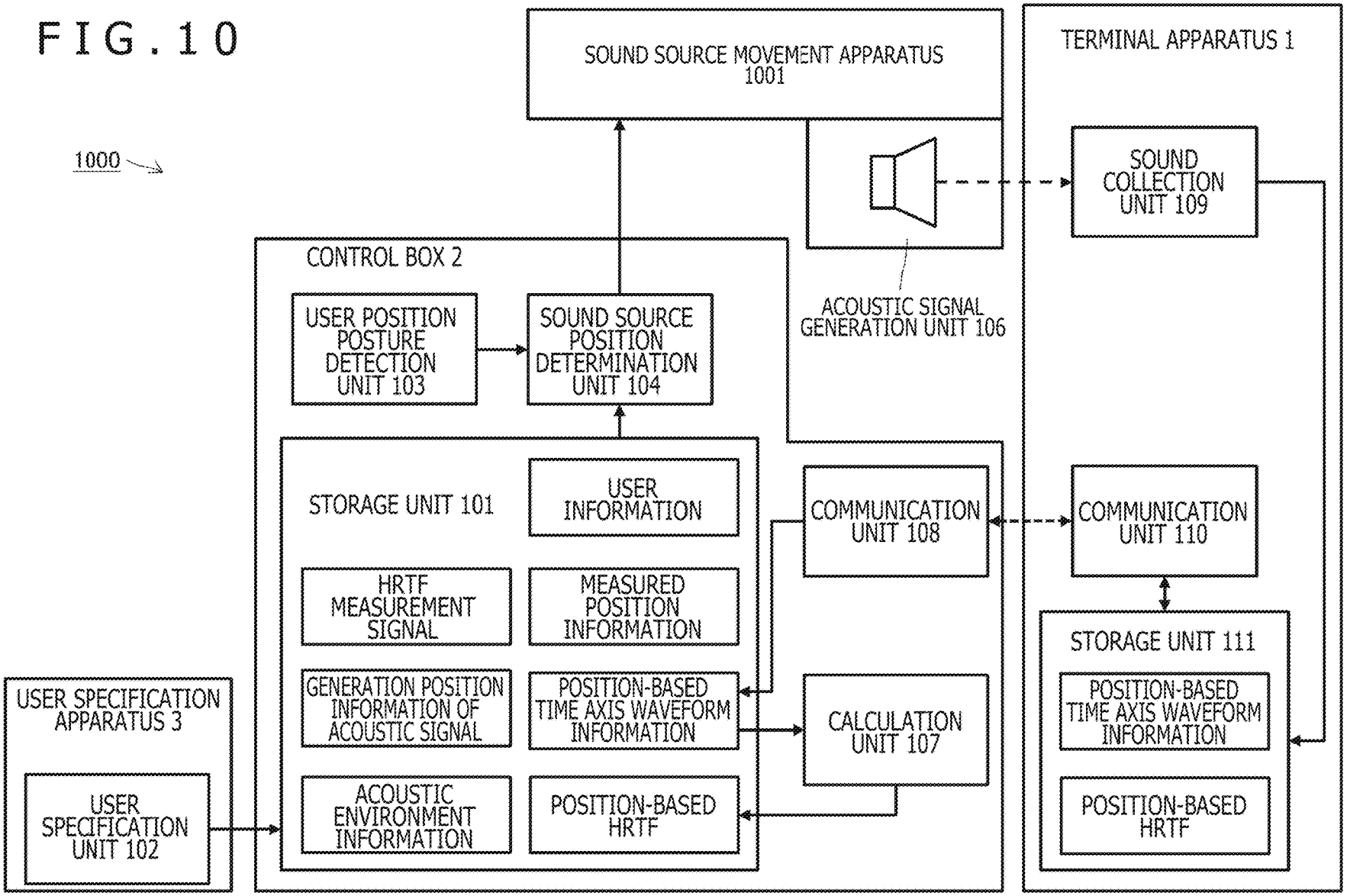
FIG. 10 is a diagram illustrating a configuration example of an HRTF measurement system 1000.

FIG. 10 illustrates a configuration example of an HRTF measurement system 1000 according to a modification of the system configuration illustrated in FIG. 2. Here, the same constituent elements as in the HRTF measurement system 100 illustrated in FIG. 2 are provided with the same reference numbers, and the detailed description will not be repeated.

In the HRTF measurement system 100 illustrated in FIG. 2, the acoustic signal generation unit 106 includes a plurality of speakers arranged at different positions, and the sound source position changing unit 105 is configured to select one of the speakers at the position determined by the sound source position determination unit 104 and cause the speaker to output the HRTF measurement signal. On the other hand, in the HRTF measurement system 1000 illustrated in FIG. 10, a sound source position movement apparatus 1001 is configured to move the acoustic signal generation unit 106 including a speaker and the like to the measurement point to generate the signal sound for HRTF measurement from the position of the sound source determined by the sound source position determination unit 104.

The user position posture detection unit 103 measures, every moment, the position and the posture of the head of the user as a measurement target. The sound source position determination unit 104 determines, each time, the sound source position not overlapping the already measured measurement points as the next measurement point, for the current position and posture of the head of the user. Furthermore, the sound source position movement apparatus 1001 causes the acoustic signal generation unit 106 to move to the measurement point determined by the sound source position determination unit 104.

The sound source position movement apparatus 1001 may be, for example, an autonomously moving pet robot or an unmanned aerial vehicle such as a drone. A speaker that can output the HRTF measurement signal is provided as the acoustic signal generation unit 106 on the pet robot or the drone. The sound source position movement apparatus 1001 moves to the measurement point determined by the sound source position determination unit 104 and causes the acoustic signal generation unit 106 to output the HRTF measurement signal. In addition, the sound source position movement apparatus 1001 may be further equipped with a sensor, such as a camera, that can measure the position and the posture of the head of the user, and in this case, the motion of the user as a measurement target can be followed so that the position of the speaker relative to the user matches the measurement point determined by the sound source position determination unit 104. The sound collection unit 109 collects, on the head of the user as a measurement target, the HRTF measurement signal output from the acoustic signal generation unit 106. Furthermore, the calculation unit 107 calculates the HRTF at the corresponding measurement point based on the collected sound data.

According to the HRTF measurement system 1000 illustrated in FIG. 10, the equipment for measurement as illustrated in FIG. 1 is not necessary, and the speakers do not have to be installed on a plurality of sections in the living room. The HRTF data of the user can be acquired in an optional environment in which the sound source position movement apparatus 1001 can operate, regardless of the place, such as in a house and an office. In addition, when the user measures the HRTF of the user, an operation for measurement, such as going through the gates 5, 6, 7, 8, . . . and walking around in the living room, is not necessary at all. While the user stands still or sits on the chair and does not move, the sound source position movement apparatus 1001 including a pet robot, a drone, or the like moves around the user to output the HRTF measurement signal from the necessary sound source position. Therefore, the HRTF data of the user can be acquired at the necessary measurement point without the user being conscious of the acquisition.

Figure 11:
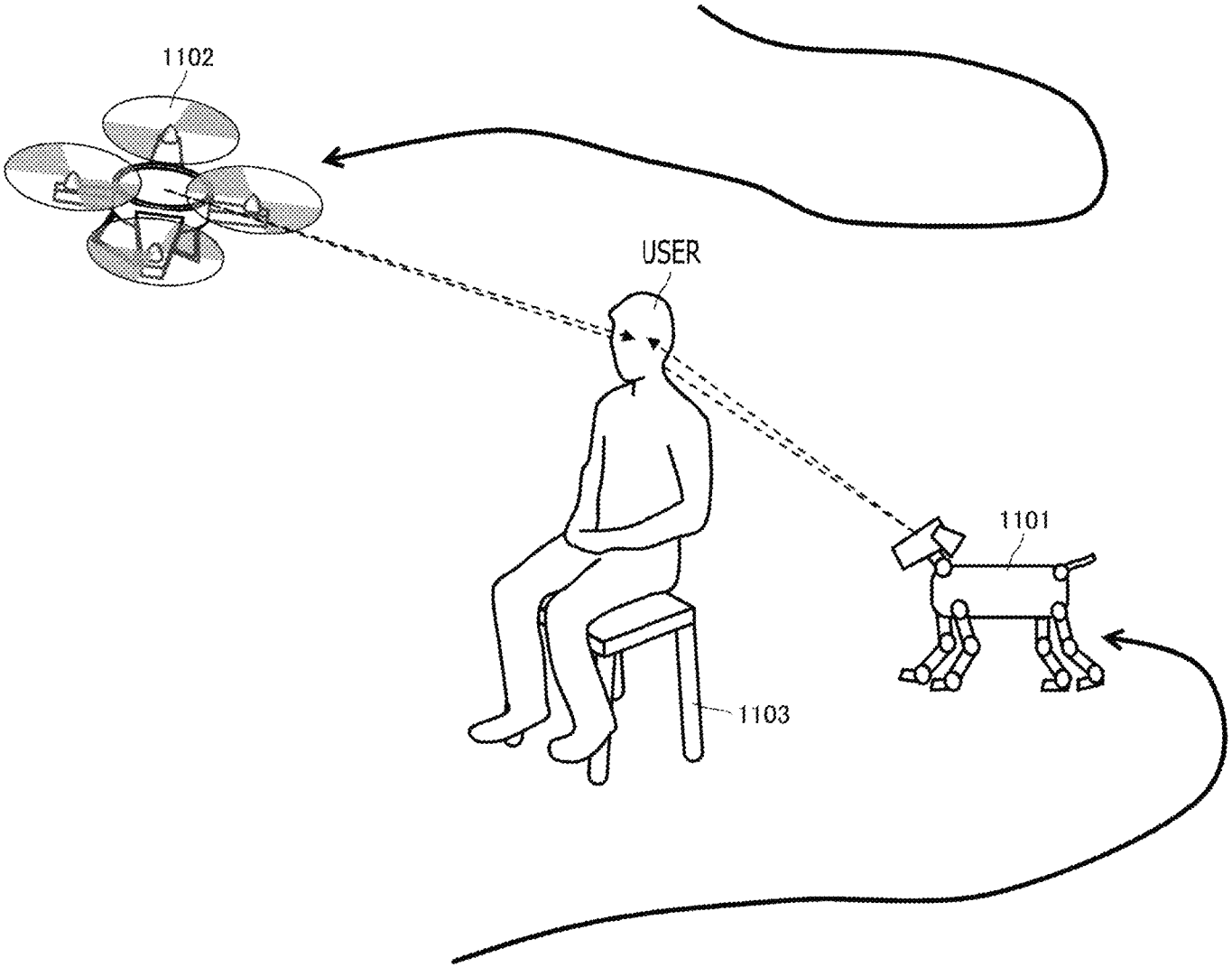
FIG. 11 is a diagram illustrating a state in which a pet robot or a drone moves around the user (state of measuring the HRTFs all around the user).

FIG. 11 illustrates a state, in which a pet robot 1101 including the acoustic signal generation unit 106 and having the function of the sound source position movement apparatus 1001 walks around the user as a measurement target or in which a drone 1102 including the acoustic signal generation unit 106 and having the function of the sound source position movement apparatus 1001 flies around the user as a measurement target.

Although the user sits on a chair 1103 and does not move, the pet robot 1101 walks around the user, and the relative position between the head of the user and the speaker provided on the pet robot 1101 changes every moment. The sound source position determination unit 104 determines, each time, the sound source position not overlapping the already measured measurement points, for the current position and posture of the head of the user. Furthermore, the pet robot 1101 walks around the user to output the HRTF measurement signals from the measurement points sequentially determined by the sound source position determination unit 104. In such a way, the sound collection and the measurement of HRTFs can be carried out at all of the measurement points to acquire the HRTF data of the user.

Note that although not illustrated, the pet robot 1101 can use a distance measurement sensor or the like to measure the distance to the head of the user to measure the distance r from the speaker of the pet robot 1101 to the head of the user and store the distance r in the database along with the HRTF measurement data. More specifically, the pet robot 1101 can move to the positions (ϕ, θ, r) of a plurality of measurement points around the head of the user to perform the HRTF measurement of the user. The pet robot 1101 as an autonomous measurement system can move to a predetermined position, and the HRTF can be measured without imposing a burden on the user. In the case of the pet robot 1101, the pet robot 1101 generally operates at a position lower than the head of the user. Therefore, the HRTF can be obviously measured at a measurement point position below the head of the user. On the other hand, because of the character of the pet robot 1101, the pet robot 1101 can make an action expressing fondness for the user to thereby prompt the user to make an action to change the direction of the face, and this can easily make the user perform an operation, such as lowering the posture to lower the position of the head and facing downward. Therefore, the HRTF measurement in which a position above the head of the user is the measurement point can also be naturally performed. That is, the HRTF of the user can be measured without losing the usefulness as a partner of the user that is the original purpose of the pet robot 1101, and there is an advantageous effect that sound information (such as music and voice service) can be localized and provided on a three-dimensional space according to the characteristics of the user.

In addition, although the user sits on the chair 1103 and does not move, the drone 1102 flies around the user, and the relative position between the head of the user and the speaker provided on the drone 1102 changes every moment. The sound source position determination unit 104 determines, each time, the sound source position not overlapping the already measured measurement points, for the current position and posture of the head of the user. Furthermore, the drone 1102 flies around the user to output the HRTF measurement signals from the measurement points sequentially determined by the sound source position determination unit 104. In such a way, the sound collection and the measurement of HRTFs can be carried out at all of the measurement points to acquire the HRTF data of the user.

Note that although not illustrated, the drone 1102 can use a distance measurement sensor or the like to measure the distance to the head of the user to measure the distance from the speaker of the drone 1102 to the head of the user and store the distance in the database along with the HRTF measurement data. More specifically, the drone 110 can move to the positions (ϕ, θ, r) of a plurality of measurement points around the head of the user to perform the HRTF measurement of the user. The drone 1102 as an autonomous measurement system can move to a predetermined position, and the HRTF can be measured without imposing a burden on the user. Furthermore, in the case of the drone 1102, it is assumed that the user uses the drone 1102 in a floating state to capture an image from the air, and an excellent advantageous effect is attained particularly in the HRTF measurement from a position higher than the head of the user.

To measure the HRTF of one user, only one mobile apparatus among the pet robot 1101, the drone 1102, and the like may be used, or two or more mobile apparatuses may be used at the same time.

The sound source movement apparatus, such as the pet robot 1101 and the drone 1102, may not only move or fly around the user to output the HRTF measurement signal from the position determined by the sound source position determination unit 104, but may also remain stationary or hover and use voice guidance, flickering of light, or the like to instruct the user to move or to change the posture.

Note that although the mobile apparatus, such as the pet robot 1101 and the drone 1102, is provided with the functions of the sound source position movement apparatus 1001 and the acoustic signal generation unit 106, the mobile apparatus may be further provided with part or all of the functions of the control box 1 and the user specification apparatus 3 in FIG. 10. In addition, the mobile apparatus, such as the pet robot 1101 and the drone 1102, may specify the user and move or fly after autonomously searching the sound source position as an unmeasured measurement point regarding the user.

Figure 18:
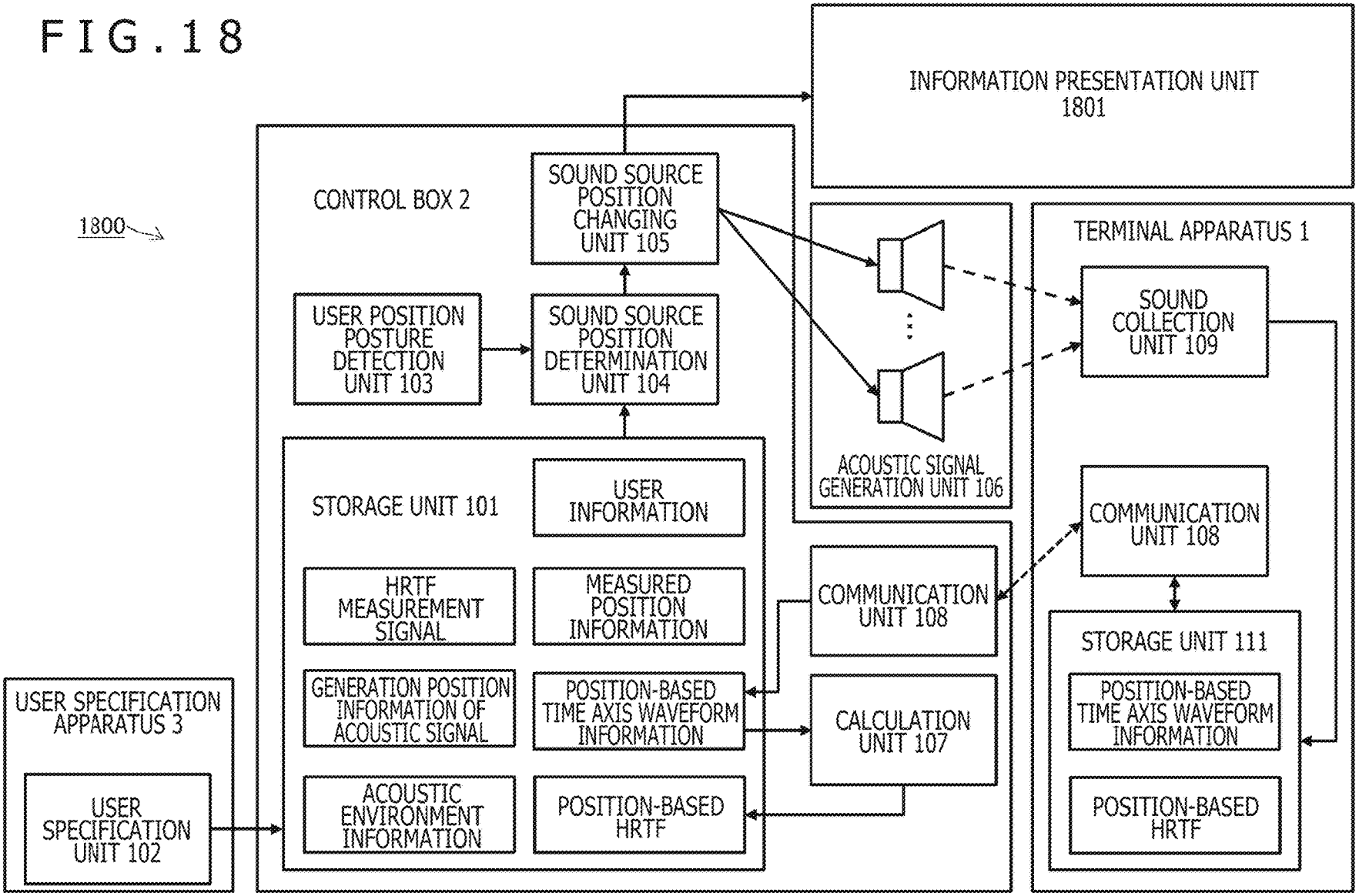
FIG. 18 is a diagram illustrating a configuration example of an HRTF measurement system 1800.

FIG. 18 illustrates a configuration example of an HRTF measurement system 1800 according to another modification of the system configuration illustrated in FIG. 2. Here, the same constituent elements as in the HRTF measurement system 100 illustrated in FIG. 2 are provided with the same reference numbers, and the detailed description will not be repeated.

In the HRTF measurement system 100 illustrated in FIG. 2, the acoustic signal generation unit 106 includes a plurality of speakers arranged at different positions, and the sound source position changing unit 105 is configured to select one of the speakers at the position determined by the sound source position determination unit 104 and cause the speaker to output the HRTF measurement signal. On the other hand, the HRTF measurement system 1800 illustrated in FIG. 18 further includes an information presentation unit 1801. Although there is no sound source (speaker) that can measure the HRTF at the position determined by the sound source position determination unit 104 as the position of the measurement point of the next HRTF measurement in a case where the user maintains the current posture (such as direction of head and face) at the current position of the head of the user, the HRTF can be measured if the user changes the posture in a predetermined direction. In this case, the information presentation unit 1801 has a function of presenting information for prompting the user to act in a direction in which the information presentation unit 1801 wants the user to change the position and the posture of the head of the user. The information presentation unit 1801 may control a display apparatus, such as a display, to display video information or may cause one of the speakers of the acoustic signal generation unit 106 to generate an acoustic signal.

The user position posture detection unit 103 measures, every moment, the position and the posture of the head of the user as a measurement target. The sound source position determination unit 104 determines, each time, the sound source position not overlapping the already measured measurement points, for the current position and posture of the head of the user. In addition, the sound source position changing unit 105 selects the best sound source for performing the HRTF measurement at the position determined by the sound source position determination unit 104.

Here, the speaker selected by the sound source position changing unit 105 may be separated from the position determined by the sound source position determination unit 104. For example, the installation of the sound sources covering all of the measurement positions may not be possible even in the system configuration including a large number of sound sources as illustrated in FIG. 1 or 9. In addition, the installation places of the sound sources may be significantly limited depending on the measurement environment, and there is a case in which not all of the measurement positions can be covered in the first place. Even in such as a case, the information presentation unit 1801 outputs the measurement signal sound from the speaker as a sound source selected by the sound source position changing unit 105 and presents the information for prompting the user to make an action from the display or the speaker at a predetermined position to set the head position of the user to a position where the HRTF of the measurement point determined by the sound source position determination unit 104 can be measured. Furthermore, the user changes the posture by making an action according to the information presented by the information presentation unit 1801, and the speaker as a sound source selected by the sound source position changing unit 105 is positioned at the measurement point determined by the sound source position determination unit 104.

Therefore, the HRTF measurement system 1800 can guide the user to set a desirable positional relation between the speaker and the head of the user, and there is also an advantage that the position-based HRTFs can be measured all around the user by using fewer speakers.

The information presentation unit 1801 can be provided by using, for example, a display, an LED (Light Emitting Diode), a light bulb, or the like. Specifically, the information presentation unit 1801 presents information to be viewed by the user (or information prompting the user to view) at a predetermined position of the display. Furthermore, when the user faces the information, the speaker selected by the sound source position changing unit 105 is in a positional relation with the user that allows to measure the HRTF of the position determined by the sound source position determination unit 104. Alternatively, the sound source position changing unit 105 selects one speaker that is in a positional relation corresponding to the position determined by the sound source position determination unit 104 with respect to the head when the user faces the information presented on the display. In any case, the speaker selected by the sound source position changing unit 105 outputs the HRTF measurement signal from the position determined by the sound source position determination unit 104 to the head of the user.

In addition, the information presentation unit 1801 can be provided by using a movement apparatus, such as the pet robot and the drone described above. Specifically, the information presentation unit 1801 prompts the user to make an action by causing the pet robot or the drone to move to a place at which the information presentation unit 1801 wants the user to face. Furthermore, when the user faces the pet robot or the drone, the speaker selected by the sound source position changing unit 105 is in a positional relation with the user that allows to measure the HRTF of the position determined by the sound source position determination unit 104. Alternatively, the sound source position changing unit 105 selects one speaker that is in a positional relation corresponding to the position determined by the sound source position determination unit 104 with respect to the head when the user faces the pet robot or the drone. In any case, the speaker selected by the sound source position changing unit 105 outputs, to the user, the HRTF measurement signal from the position determined by the sound source position determination unit 104.

In addition, the information presentation unit 1801 can be provided by using one of the plurality of speakers included in the acoustic signal generation unit 106. Specifically, the information presentation unit 1801 presents, from the speaker at the place where the information presentation unit 1801 wants the user to face, acoustic information for the user to face. Furthermore, when the user faces the sound source information, the speaker selected by the sound source position changing unit 105 as a speaker for outputting the HRTF measurement signal is in a positional relation corresponding to the position determined by the sound source position determination unit 104 with respect to the head of the user. Alternatively, the sound source position changing unit 105 selects one speaker in a positional relation that allows to measure the HRTF of the position determined by the sound source position determination unit 104, with respect to the head when the user faces the speaker from which the information presentation unit 1801 presents the acoustic information. In any case, the speaker selected by the sound source position changing unit 105 outputs the HRTF measurement signal from the position determined by the sound source position determination unit 104 to the head of the user.

Figure 19:
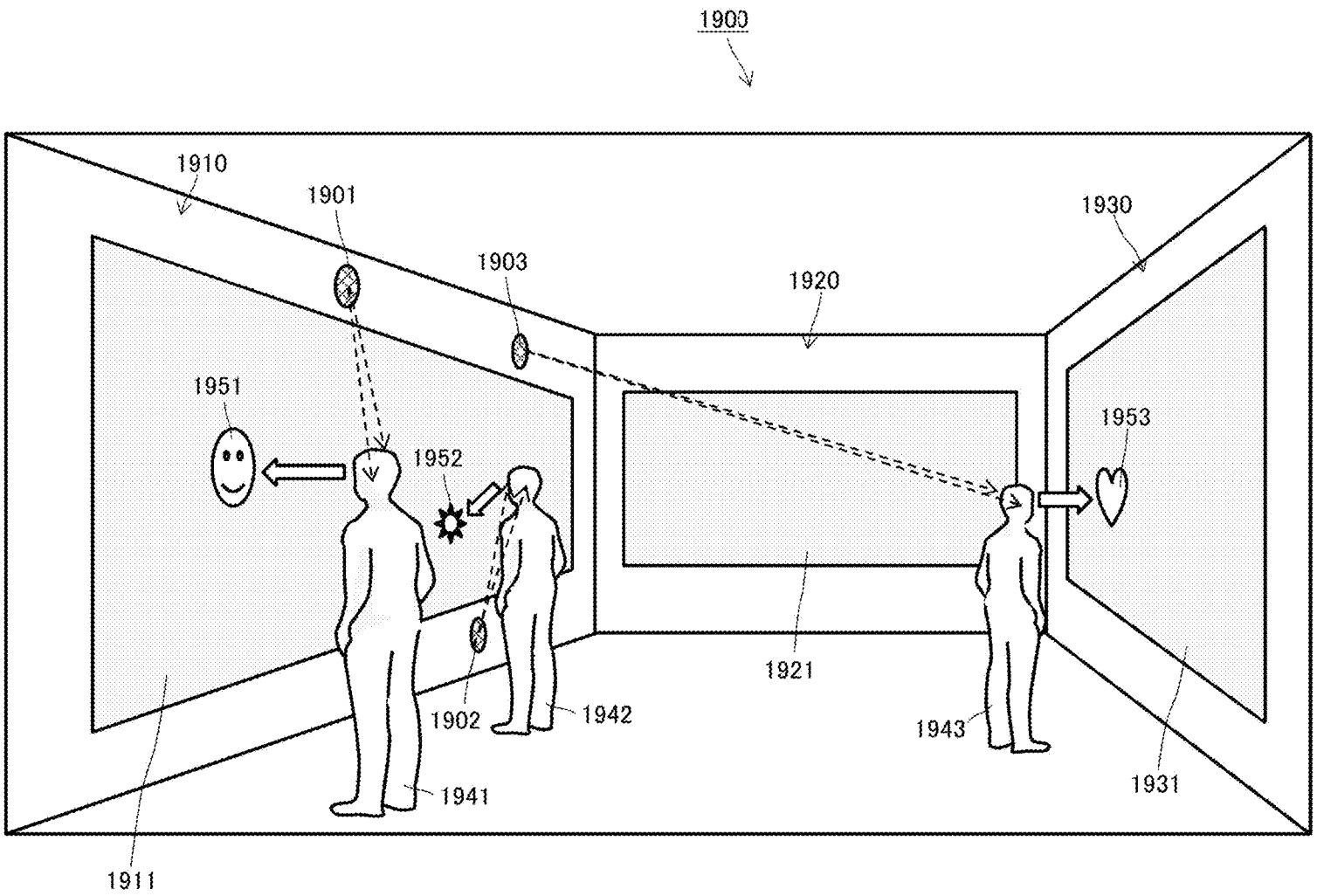
FIG. 19 is a diagram illustrating an implementation example of the HRTF measurement system 1800.

FIG. 19 illustrates an implementation example of the HRTF measurement system 1800. In the implementation example illustrated in FIG. 19, a display is used as the information presentation apparatus 1801 that presents the information for prompting the user to make an action. Specifically, displays 1911, 1921, and 1931 with large screens are installed on wall surfaces 1910, 1920, and 1930 of a room 1900, respectively. In addition, a plurality of speakers 1901, 1902, and 1903 that can output HRTF measurement signal sound is installed in the room 1900. The speakers 1901, 1902, and 1903 may not be dedicated for outputting the HRTF measurement signal sound (that is, dedicated to the acoustic signal generation unit 106), and for example, the speakers 1901, 1902, and 1903 may also serve as speakers for other usage, such as speakers for public address system. Furthermore, a plurality of users 1941, 1942, and 1943 walks around in the room 1900.

The user specification unit 102 specifies the users 1941, 1942, and 1943 in the room 1900. In addition, the user position posture detection unit 103 measures the position and the posture of the head of each of the users 1941, 1942, and 1943.

The sound source position determination unit 104 refers to the measured position information of the users 1941, 1942, and 1943 managed in the storage unit 101 and determines the position ($\phi$, $\theta$, r) of the sound source for measuring the HRTF next for each of the users 1941, 1942, and 1943 so that the HRTF of an already measured position is not repeatedly measured. Furthermore, the sound source position changing unit 105 respectively selects the best speakers 1901, 1902, and 1903 for performing the HRTF measurement at the positions determined by the sound source position determination unit 104 for the users 1941, 1942, and 1943. However, the speakers 1901, 1902, and 1903 are separated from the positions determined by the sound source position determination unit 104 for the users 1941, 1942, and 1943, respectively.

The information presentation unit 1801 presents information for prompting the user to view at predetermined positions of the displays 1911, 1921, and 1931. Specifically, the information presentation unit 1801 displays information 1951 for prompting the user 1941 to view on the display 1911 and displays information 1952 for prompting the user 1942 to view. In addition, the information presentation unit 1801 displays information 1953 for prompting the user 1943 to view on the display 1931. The information 1951, 1952, and 1953 includes image information for making opportunities for the users 1941, 1942, and 1943 to change the directions of the heads, and the information 1951, 1952, and 1953 may be, for example, avatars of the users 1941, 1942, and 1943.

When the user 1941 faces the information 1951, the speaker 1901 is in a positional relation corresponding to the position determined by the sound source position determination unit 104 with respect to the head of the user 1941. Similarly, when the user 1942 faces the information 1952, the speaker 1902 is in a positional relation with the head of the user 1942 that allows to measure the HRTF of the position determined by the sound source position determination unit 104, and when the user 1943 faces the information 1953, the speaker 1903 is in a positional relation with the head of the user 1943 that allows to measure the HRTF of the position determined by the sound source position determination unit 104. In such a way, the speakers 1901, 1902, and 1903 selected by the sound source position changing unit 105 output the HRTF measurement signals from the positions determined by the sound source position determination unit 104 to the heads of the users 1941, 1942, and 1943, respectively.

The sound collection unit 109 of the terminal apparatus mounted on the head of each of the users 1941, 1942, and 1943 collects the HRTF measurement signal. Furthermore, the data measured by the sound collection unit 109 is temporarily stored in the storage unit 111 and transmitted from the terminal apparatus 1 to the control box 2 side through the communication unit 110. On the control box 2 side, the data measured by the sound collection unit 109 is received through the communication unit 108, and the calculation unit 107 calculates the HRTF of the position determined by the sound source position determination unit 104 for each of the users 1941, 1942, and 1943.

An operation example of making the user change the posture in the HRTF measurement system 1800 (another implementation example of the HRTF measurement system 1800) will be more specifically described with reference to FIGS. 23 and 24.

Figure 23:
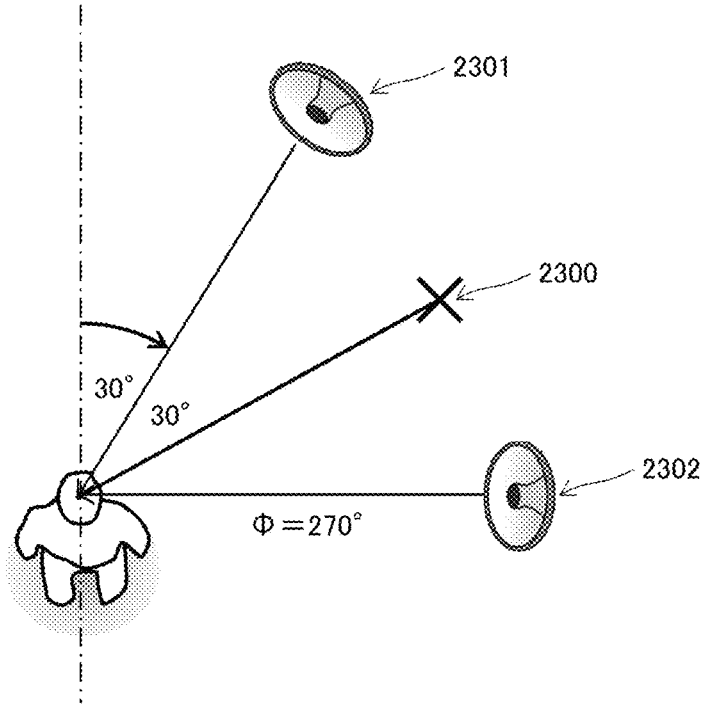
FIG. 23 is a diagram illustrating an operation example of making the user change the posture in the HRTF measurement system 1800.

FIG. 23 illustrates a state in which the user currently faces the direction of $\phi$=zero degrees. Reference number 2300 illustrates a position ($\phi$=300°, $\theta$=0°, r) of the HRTF measurement point determined by the sound source position determination unit 104 from the unmeasured measurement points. In addition, although speakers 2301 and 2302 are arranged at positions of $\phi$=270 degrees and $\phi$=330 degrees, respectively, a speaker is not arranged at a position of $\phi$=300°. Therefore, the information presentation unit 1801 causes the speaker 2301 at $\phi$=330 degrees to generate an acoustic signal for making the user change the posture. That is, the information presentation unit 1801 uses the speaker 2301 to present information for prompting the user to make an action in the direction in which the information presentation unit 1801 wants the user to change the position and the posture of the head of the user.

Figure 24:
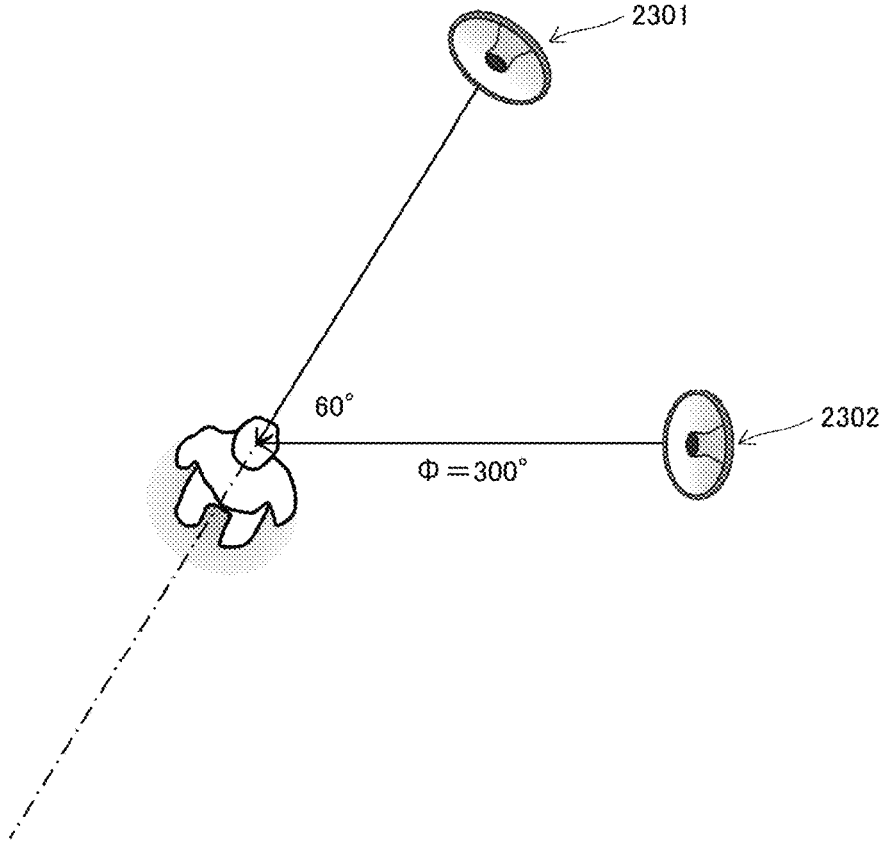
FIG. 24 is a diagram illustrating the operation example of making the user change the posture in the HRTF measurement system 1800.

Furthermore, as illustrated in FIG. 24, the user changes the posture based on the acoustic signal, and the user faces the speaker 2301 at $\phi$=330 degrees in the previous posture of the user. In such a way, the speaker 2302 arranged at the position of $\phi$=270 degrees in the previous posture of the user is arranged at a position of $\phi$=300 degrees that is the measurement point. As a result, the speaker 2302 at $\phi$=300 degrees can be controlled to cause the speaker 2302 to generate the HRTF measurement signal to measure the HRTF at the desirable position.

Next, a specific configuration of the terminal apparatus 1 will be described.

As already described with reference to FIG. 2, the terminal apparatus 1 is equipped with the sound collection unit 109 that collects the HRTF measurement signal output from the acoustic signal generation unit 106, the communication unit 110 that transmits the collected sound data to the control box 1 (or mutually communicates with the control box 1), and the like.

In the present embodiment, individual differences in the heads, the bodies, the shapes of the earlobes, and the like of the users are taken into account, and the terminal apparatus 1 including the sound collection unit 109 has an in-ear body structure in order to collect sound close to the state in which the sound reaches the eardrums of individual users.

Figure 12:
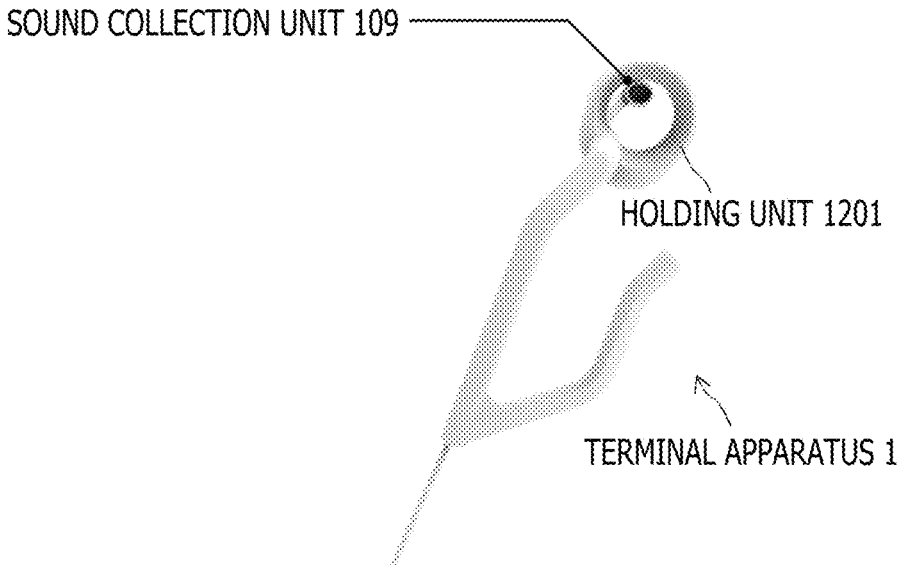
FIG. 12 is a diagram illustrating an external configuration example of the terminal apparatus 1.

FIG. 12 illustrates an external configuration example of the terminal apparatus 1. In addition, FIG. 13 illustrates a state in which the terminal apparatus 1 illustrated in FIG. 12 is mounted on the left ear of a person (dummy head). Note that although FIGS. 12 and 13 illustrate only the terminal apparatus 1 for the left eye, it should be understood that a set of left and right terminal apparatuses 1 is mounted on the left and right ears of the user as a measurement target to collect the sound of the HRTF measurement signal.

As can be understood from FIGS. 12 and 13, the body of the terminal apparatus 1 includes the sound collection unit 109 including a microphone and the like; and a holding unit 1201 that holds the sound collection unit 109 near the entrance of the ear canal (for example, connected to the intertragic notch). The holding unit 1201 has a hollow ring shape and includes an opening portion that passes sound. Preferably, as illustrated in FIG. 13, the holding unit 1201 is inserted into the cavity of the concha, abutted against the wall of the cavity of the concha, integrated with the sound channel heading downward from the holding unit, hooked to the V-shaped intertragic notch, and locked to the auricle. In such a way, the terminal apparatus 1 is suitably mounted on the auricle.

The holding unit 1201 has a hollow structure as illustrated, and almost all of the inside is an opening portion. The holding unit 1201 does not close the ear hole of the user even in the state in which the holding unit 1201 is inserted into the cavity of the concha. That is, the earhole of the user is open, and the terminal apparatus 1 is an open-ear type. It can be stated that the terminal apparatus 1 has acoustic permeability even during the sound collection of the HRTF measurement signal. Therefore, even in a case of, for example, measuring the HRTF while the user is relaxing in the living room as illustrated in FIG. 9, the earhole is open, and therefore, the user can accurately hear the voice spoken by the family member and other ambient sound. Thus, the user can also measure the HRTF in parallel with everyday life with almost no problem.

A change in the ambient sound may also occur due to the influence of the diffraction or the reflection on the surface of the human body, such as the head, the body, and the earlobe of the user. According to the terminal apparatus 1 of the present embodiment, the sound collection unit 109 is provided near the entrance of the ear canal, and therefore, the influence of the diffraction or the reflection on each part of the human body, such as the head, the body, and the earlobe of each user, can be taken into account to obtain a highly accurate head related transfer function expressing the change in the sound.

Next, signal processing in the HRTF measurement system 100 according to the present embodiment will be described.

On the control box 2 side, the sound source position determination unit 104 checks, in the storage unit 101, the measured position information of the user specified by the user specification unit 102 and further determines the position of the sound source for measuring the HRTF next from the relative position between the head position and posture information of the user obtained by the user position posture detection unit 103 and the acoustic signal generation unit 106 so that the HRTF of the measured position information is not repeatedly measured.

The acoustic signal generation unit 106 includes a plurality of speakers that can output HRTF measurement signals. The sound source position changing unit 105 causes the speaker at the position determined by the sound source position determination unit 104 to output the HRTF measurement signal. It is preferable that the HRTF measurement signal be a broadband signal with known phase and amplitude, such as TSP (Time Stretched Pulse). Detailed information regarding the HRTF measurement signal is stored in the storage unit 101, and the HRTF measurement signal based on the information is output from the speaker.

The HRTF measurement signal output from the acoustic signal generation unit 106 is propagated through the space. The acoustic transfer function unique to the user, such as the influence of the diffraction and the reflection on the surface of the human body including the head, the body, the earlobe, or the like of the user, is further applied to the HRTF measurement signal, and the sound of the HRTF measurement signal is collected by the sound collection unit 109 in the terminal apparatus 1 mounted on the user. Subsequently, the collected sound data is transmitted from the terminal apparatus 1 to the control box 2.

On the control box 2 side, once the communication unit 108 receives the collected sound data transmitted from the terminal apparatus 1, the collected sound data is stored as position-based time axis waveform information in the storage unit 101 in association with the position determined by the sound source position determination unit 104.

Subsequently, the calculation unit 107 reads the position-based time axis waveform information from the storage unit 101 to calculate the HRTF and stores the HRTF as a position-based HRTF in the storage unit 101. In addition, the information of the position where the HRTF is measured is stored as measured position information in the storage unit 101.

In calculating the HRTF, the calculation unit 107 performs quality determination to determine whether or not the data measured by the sound collection unit 109 is correctly measured. For example, the measurement data stored in the storage unit 101 is discarded in a case where large noise is mixed in the measurement data.

In addition, an unmeasured or remeasurement flag is set for the measurement point for which the quality determination has failed, and the measurement of the HRTF is repeated later. For example, the position for which the quality determination has failed can be deleted from the measured position information in the storage unit 101, and the sound source position determination unit 104 can later determine the position as the sound source position again.

Figures 14, 15:
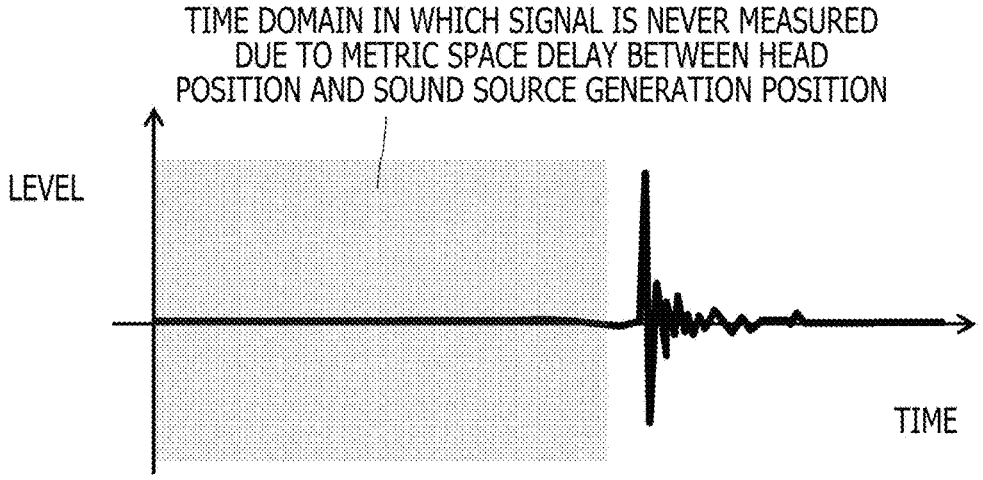
FIG. 14 is a diagram illustrating an example of data collected by a sound collection unit 109.
FIG. 15 is a diagram illustrating an example of a data structure of a table storing information of each measurement point.

For example, based on the relative positional relation between the head position of the user obtained by the user position posture detection unit 103 and the acoustic signal generation unit 106 (or speaker used to output HRTF measurement signal), there is a time domain in which the measurement signal is not measured due to the metric space delay of the sound wave until the sound is collected by the sound collection unit 109 after the HRTF measurement signal is output (see FIG. 14). In a case where the signal is measured in the time domain, it can be assumed that the collected sound data is not correctly measured, and the collected sound data in the time domain can be determined as no-signal.

In addition, the information of the acoustic environment at the measurement place of the HRTF (such as acoustic characteristics in the room) as illustrated in FIG. 1 or 9 may be measured in advance. The quality determination of the collected sound data may be performed based on the acoustic information, or the noise included in the collected sound data may be removed.

Furthermore, quality determination of the HRTF data calculated by the calculation unit 107 is also performed. This can determine poor quality of the measurement that cannot be determined from the collected sound data. An unmeasured or remeasurement flag is set for the measurement point for which the quality determination of the HRTF has failed, and the measurement of the HRTF is repeated later. For example, the position for which the quality determination has failed can be deleted from the measured position information in the storage unit 101, and the sound source position determination unit 104 can later determine the position as the sound source position again.

FIG. 15 illustrates an example of a data structure of a table storing information of each measurement point in the storage unit 101. The illustrated table is provided in the storage unit for, for example, each user as a measurement target. However, in the case where the measurement is performed for each of the right ear and the left ear of the user, a table for right ear and a table for left ear are provided to the user as a measurement target.

An entry is defined for each measurement point (that is, each measurement point number) in the table. Each entry includes a field storing information of the position of the corresponding measurement point relative to the user, a field storing distance information between the head of the user at the measurement and the speaker used for the measurement, a position-based time axis waveform information field storing waveform data of the sound wave collected by the sound collection unit 109 from the HRTF measurement signal output at the measurement point, a position-based HRTF field calculated by the calculation unit 107 based on the waveform data stored in the position-based time axis waveform information field, a measured flag indicating whether or not the HRTF is measured at the measurement point or the like, and a priority field indicating the priority of measuring the measurement point. The measured flag is data of 2 or more bits indicating "measured," "unmeasured," "remeasurement," "approximate measurement," or the like. Although not illustrated in FIG. 15, in the case where "approximate measurement" is possible, it is desirable to include a field storing the approximated position information or information indicating the address of the storage area storing the position information.

On the control box 2 side, the sound source position determination unit 104 refers to the table of the user specified by the user specification unit 102 in the storage unit 101 to select a measurement point with a high priority from the measurement points in which the measurement flag is not "measured" (that is, HRTF is unmeasured) and determines the position of the sound source for measuring the HRTF next. Furthermore, the sound source position changing unit 105 causes the speaker at the position determined by the sound source position determination unit 104 to output the HRTF measurement signal.

The HRTF measurement signal output from the acoustic signal generation unit 106 is propagated through the space. The acoustic transfer function unique to the user, such as the influence of the diffraction and the reflection on the surface of the human body including the head, the body, the earlobe, or the like of the user, is further applied to the HRTF measurement signal, and the sound of the HRTF measurement signal is collected by the sound collection unit 109 in the terminal apparatus 1 mounted on the user. Subsequently, the collected sound data is transmitted from the terminal apparatus 1 to the control box 2.

On the control box 2 side, once the communication unit 108 receives the collected sound data transmitted from the terminal apparatus 1, the collected sound data is stored in the position-base time axis waveform information field of the entry corresponding to the position determined by the sound source position determination unit 104 in the table illustrated in FIG. 15. In this case, the "measured" flag of the same entry is set to prevent repeatedly measuring the HRTF at the same measurement point.

Quality determination is applied to the collected sound data stored in the position-based time axis waveform information field of each entry to determine whether or not the collected sound data is correctly measured. Here, in a case where the quality determination of the collected sound data has failed, the measured flag of the corresponding entry is set to "unmeasured." The sound source position determination unit 104 can later determine the same measurement point as a sound source position again.

On the other hand, in a case where the quality determination is successful, the calculation unit 107 calculates the HRTF from the collected sound data and stores the HRTF in the position-based HRTF in the same entry. In addition, quality determination of the HRTF data calculated by the calculation unit 107 is also performed. In such a way, poor quality of the measurement that cannot be determined from the collected sound data can be determined. Here, in a case where the quality determination of the HRTF data has failed, the measured flag of the corresponding entry is set to "unmeasured." The sound source position determination unit 104 can later determine the same measurement point as a sound source position again.

Note that in a case where the measurement of the HRTFs of all of the measurement points cannot be finished within a defined time, the HRTFs unique to the user that can be measured and the HRTFs and the feature amounts of the other users measured in the past may be used to complete the HRTF data unique to the user.

In addition, an average value of the HRTFs of a plurality of other users measured in the past may be stored as an initial value in the position-based HRTF field of each entry in the table in the initial state (see FIG. 15). In such a way, an average HRTF can be used to provide an acoustic service to the user not finished with the measurement yet. Subsequently, the value of the position-based HRTF field of the corresponding entry can be sequentially rewritten from the initial value to the measured value every time the HRTF of each measurement point is measured. In this case, it is sufficient if data indicating "average value" is recorded in the measured flag in advance.

The S/N of each frequency band in the HRTF measurement signal can be adjusted according to the stationary noise of the measurement environment to realize more robust measurement of HRTF. For example, in a case where there is a band that cannot secure the S/N in the normal HRTF measurement signal, the HRTF measurement signal can be processed to secure the S/N of the band to realize stable HRTF measurement. The HRTF measurement signal will be described with reference to FIGS. 16A, 16B, 16C, 16D.

In general, the power is inversely proportional to the frequency in the stationary noise of the measurement environment, and the noise is often similar to so-called pink noise, in which the lower the frequency, the larger the noise. Therefore, when the normal TSP signal is used for the measurement, the lower the frequency, the worse the S/N ratio of the measured signal sound and the environmental noise tends to be (see FIG. 16A).

A pink TSP (see FIG. 16B), which is a pulse, in which the amplitude is not constant in all of the bands (audible range), the power is inversely proportional to the frequency, and the lower the frequency, the higher the amplitude, can be used as an HRTF measurement signal, and a constant S/N ratio can be secured in the entire audible band.

Figure 16A:
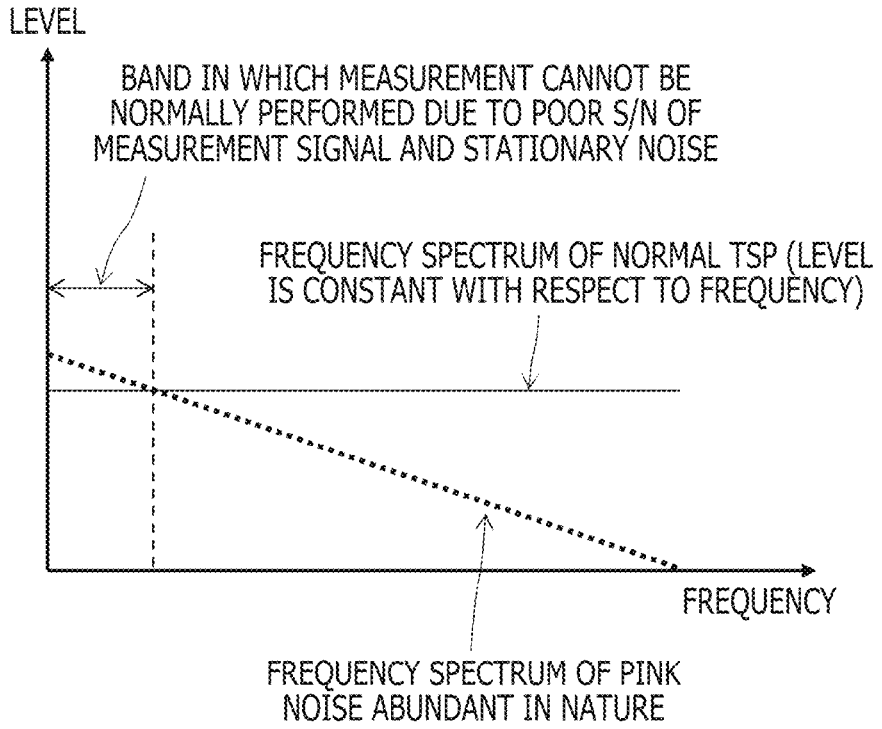
FIG. 16A is a diagram for describing an HRTF measurement signal.
Figure 16B:
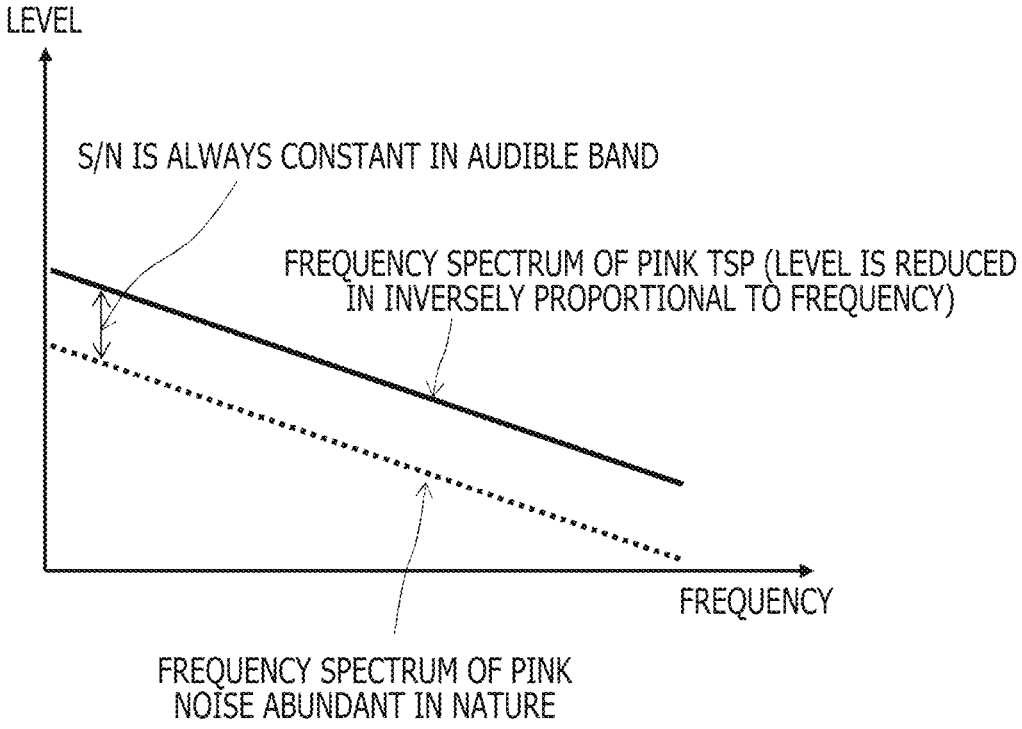
FIG. 16B is a diagram for describing an HRTF measurement signal.
Figure 16C:
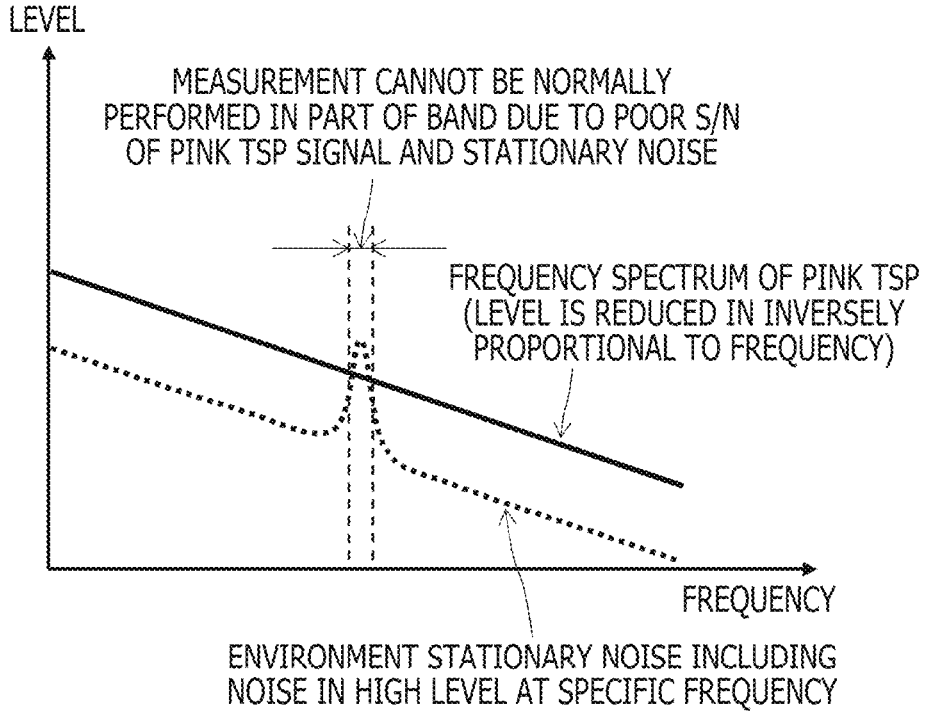
FIG. 16C is a diagram for describing an HRTF measurement signal.
Figure 16D:
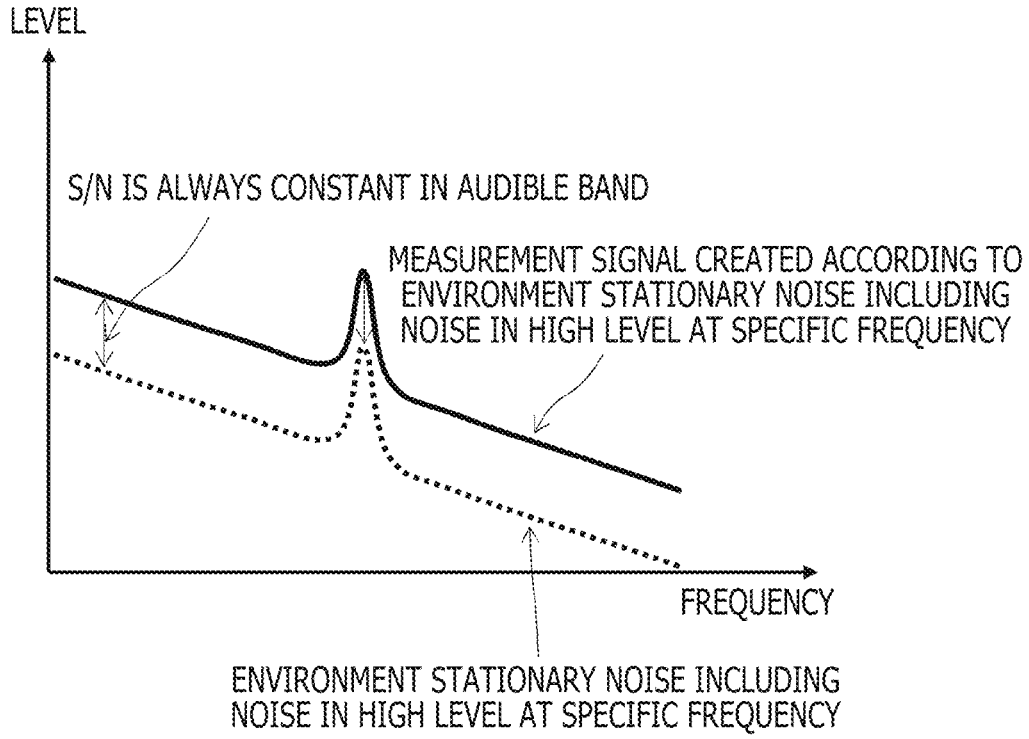
FIG. 16D is a diagram for describing an HRTF measurement signal.

However, the environmental stationary noise may not only be simple pink noise but may be environmental stationary noise including noise in a high level at a specific frequency as illustrated in FIG. 16C. To realize stable HRTF measurement even in such an environment, the amplitude may not be constant in all of the bands (audible range), and a time-stretch pulse, in which the amplitude of each frequency is adjusted according to the frequency spectrum of the stationary noise in the measurement environment as illustrated in FIG. 16D, may be used for the HRTF measurement signal.

In addition, the HRTF largely depends on the shapes of the head and the auricles of the user. Therefore, the HRTF has a feature that individual differences in characteristics are large in a high frequency, but the differences in characteristics are relatively small in a low frequency. Therefore, in a case where the S/N ratio cannot be secured due to the influence of the environmental noise in the low frequency, the HRTF may not be measured in the low frequency. HRTF characteristics that are already measured and that are not influenced by the environmental noise in the low frequency may be combined to stabilize the HRTF measurement.

Figure 17:
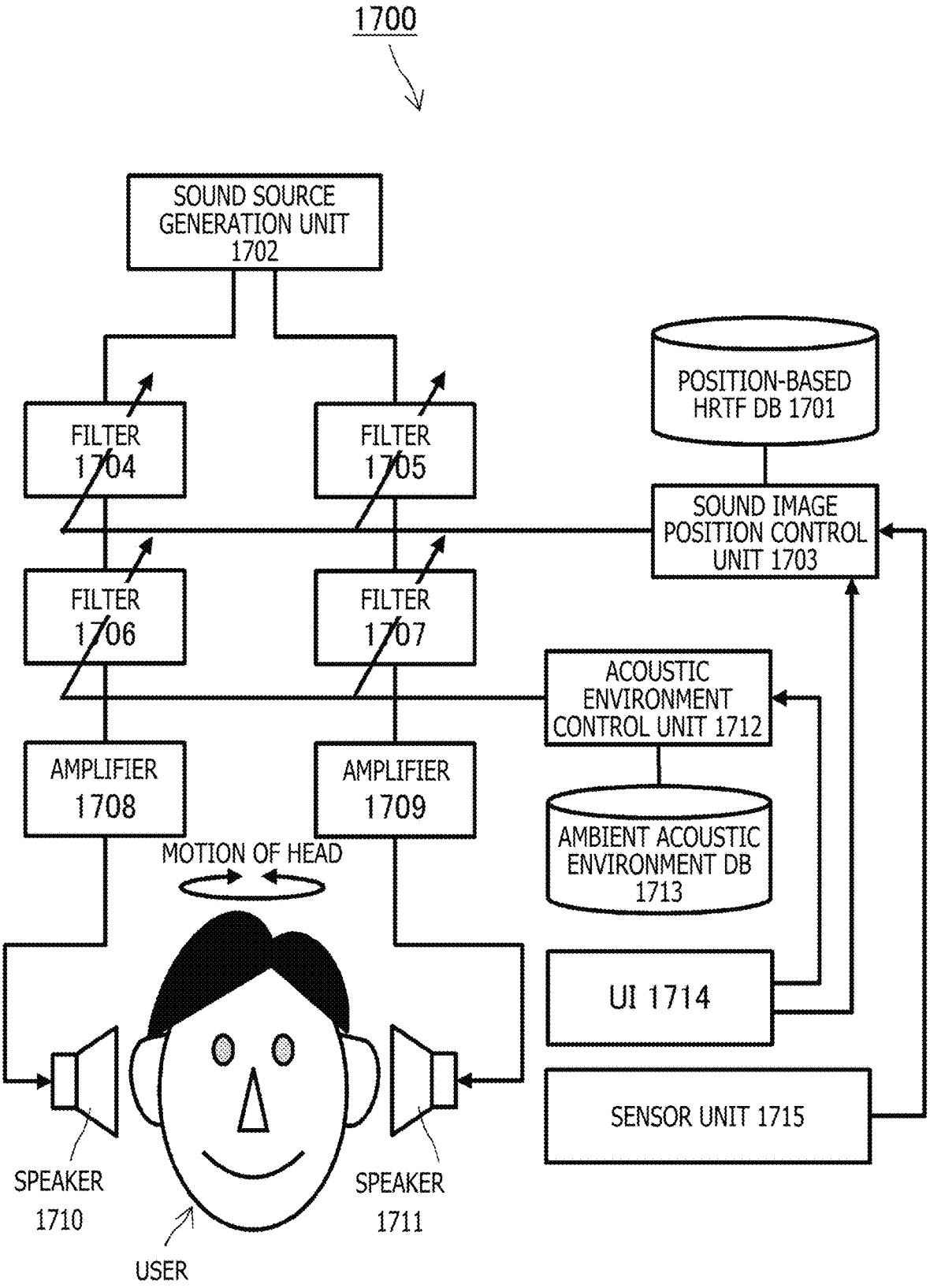
FIG. 17 is a diagram illustrating a configuration example of an acoustic output system 1700 that uses position-based HRTFs.

FIG. 17 illustrates a configuration example of an acoustic output system 1700 that uses the position-based HRTF acquired by the HRTF measurement system 100 according to the present embodiment.

The HRTF corresponding to the position of the sound source, that is, the position from the head of the user, is accumulated in a position-based HRTF database 1701. Specifically, the HRTF measurement system 100 accumulates the HRTFs measured for the users on the basis of positions (that is, HRTF data of each user).

A sound source generation unit 1702 reproduces a sound signal for the user to listen. The sound source generation unit 1702 may be, for example, a content reproduction apparatus that reproduces a sound data file stored in a medium, such as a CD (Compact Disc) and a DVD (Digital Versatile Disc). Alternatively, the sound source generation unit 1702 may generate sound of music supplied (streaming delivery) from the outside through a wireless system, such as Bluetooth (registered trademark), Wi-Fi (registered trademark), and a mobile communication standard (LTE (Long Term Evolution), LTE-Advanced, 5G, or the like). Alternatively, the sound source generation unit 1702 may receive sound automatically generated or reproduced by a server on a network (or cloud), such as the Internet, using a function of artificial intelligence or the like, sound (including sound recorded in advance) obtained by collecting voice of a remote operator (or instructor, voice actor, coach, or the like), or the like through a network and generate the sound on the system 1700.

A sound image position control unit 1703 controls a sound image position of the sound signal reproduced from the sound source generation unit 1702. Specifically, the sound image position control unit 1703 reads, from the position-based HRTF database 1701, the position-based HRTFs at the time that the sound output from the sound source at a desirable position reaches the left and right ears of the user. The sound image position control unit 1703 sets the position-based HRTFs in filters 1704 and 1705. The filters 1704 and 1705 convolve the position-based HRTFs of the left and right ears of the user into the sound signal reproduced from the sound source generation unit 1702. Furthermore, the sound passing through the filters 1704 and 1705 is amplified by amplifiers 1708 and 1709 and acoustically output from speakers 1710 and 1711 toward the left and right ears of the user.

Although the sound output from the speakers 1710 and 1711 is heard in the head of the user in a case where the position-based HRTFs are not convolved, the sound can be localized outside of the head of the user by convolving the position-based HRTFs. Specifically, the user hears the sound as if the sound is generated from the sound source position at the position of the sound source in measuring the HRTF. That is, the filters 1704 and 1705 can convolve the position-based HRTFs, and the user can recognize the sense of direction and some distance of the sound source reproduced by the sound source generation unit 1702 to localize the sound. Note that the filters 1704 and 1705 that convolve the HRTFs can be realized by FIR (Finite Impulse Response) filters, and in addition, filters approximated by a combination of computation and IIR (Infinite Impulse Response) on the frequency axis can also similarly realize the sound localization.

In the acoustic output system 1700 illustrated in FIG. 17, filters 1706 and 1707 further convolve desirable acoustic environment transfer functions into the sound signals passed through the filters 1704 and 1705 in order to fit the sound source as a sound image into the ambient environment during the reproduction. The acoustic environment transfer functions stated here mainly include information of the reflected sound and the reverberation. Ideally, it is desirable to use transfer functions (impulse responses) or the like between two appropriate points (for example, between two points: the position of a virtual speaker and the position of the ear) by assuming the actual reproduction environment or an environment close to the actual reproduction environment. In addition, acoustic environment transfer functions corresponding to the types of acoustic environment are accumulated in an ambient acoustic environment database 1713, and an acoustic environment control unit 1712 reads desirable acoustic environment transfer functions from the ambient acoustic environment database 1713 and sets the acoustic environment transfer functions in the filters 1706 and 1707. Note that an example of the acoustic environment includes a special acoustic space, such as a concert venue and a movie theater. By setting proper acoustic environment transfer functions in the filters 1706 and 1707, the user can enjoy the sound of music reproduced from the sound source generation unit 1702 as if the user is listening to the music in a concert venue.

The user may select the position of sound localization (position from the user to the virtual sound source) or the type of acoustic environment through a user interface (UI) 1714. The sound image position control unit 1703 and the acoustic environment control unit 1712 read corresponding filter coefficients from the position-based HRTF database 1701 and the ambient acoustic environment database 1713, respectively, according to the user operation through the user interface 1714 and set the filter coefficients in the filters 1704 and 1705 and the filters 1706 and 1707. For example, the position for localizing the sound source and the acoustic environment may vary according to the differences in hearing sensation of individual users or according to the use conditions. Therefore, if the user can designate the sound source position and the acoustic environment through the user interface 1714, the convenience of the acoustic output system 1700 increases. Note that an information terminal, such as a smartphone, possessed by the user can be utilized for the user interface 1714.

In the present embodiment, the HRTF measurement system 100 measures the position-based HRTFs for each user, and the position-based HRTFs of each user are accumulated in the position-based HRTF database 1701 on the acoustic output system 1700 side. For example, the acoustic system 1700 may be further provided with a user identification function (not illustrated) for identifying the user, and the sound image position control unit 1703 may read the position-based HRTFs corresponding to the identified user from the position-based HRTF database 1701 to automatically set the position-based HRTFs in the filters 1704 and 1705. Note that face authentication or biometric authentication using biometric information, such as fingerprint, voiceprint, iris, and vein, may be used as the user identification function.

Furthermore, the acoustic output system 1700 may execute a process of fixing the sound image position to the real space in conjunction with the motion of the head of the user. For example, a sensor unit 1715 including a GPS, an acceleration sensor, a gyro sensor, or the like detects the motion of the head of the user, and the sound image position control unit 1703 reads the position-based HRTFs from the position-based HRTF database 1701 according to the motion of the head and automatically updates the filter coefficients of the filters 1704 and 1705. In such a way, even in a case where the motion of the head of the user is changed, the HRTFs can be controlled so that the sound can be heard from the sound source at a certain place on the real space. It is preferable to control the HRTF automatic update after the user designates the position for localizing the sound of the sound source through the user interface 1714.

Note that the sound image position control unit 1703 and the acoustic environment control unit 1712 may be software modules realized by a program executed on a processor, such as a CPU (Central Processing Unit), or may be dedicated hardware modules. In addition, the position-based HRTF database 1701 and the ambient acoustic environment database 1713 may be stored in a local memory (not illustrated) of the acoustic output system 1700 or may be databases on an external storage apparatus that can be accessed through a network.

Physical characteristics of the user as a measurement target will be described. It is known that there are individual differences in the HRTF due to the influence of differences in the physical characteristics of the shapes of the auricles or the like. Therefore, in a case where the size of the head of the user as a subject can be measured during or before the use of the HRTF measurement system according to the present embodiment, the center of the spherical coordinates can be set at the center of the distance between the ears.

As for the measurement of the physical characteristics in the HRTF measurement system, an image capturing apparatus (not illustrated), such as a camera, can be incorporated in each example of the present specification to image the head of the user as a subject that operates in the HRTF measurement system, and a technique, such as image processing, can be used to analyze the captured image. In such a way, information, such as the vertical and horizontal size of the auricle of the ear of the user, the vertical and horizontal size of the cavity of the concha, the distance between the auricles as viewed from above the head, the distance between the ears (described above), the head posture (the front of the head (semicircle), the back of the head (semicircle)), and the head distance (distance from the tip of the nose to the edge of the back of the head as viewed from the side of the head), can be acquired, and the information can be used as parameters in the HRTF calculation. As a result, more accurate sound localization can be provided based on the HRTF data measured for individuals.

INDUSTRIAL APPLICABILITY

The technique disclosed in the present specification has been described in detail with reference to the specific embodiment. However, it is apparent that those skilled in the art can modify or substitute the embodiment without departing from the scope of the technique disclosed in the present specification.

The technique disclosed in the present specification can be applied to measure the position-based HRTFs all around the user without using large-scale equipment such as a large speaker traverse (movement apparatus). In addition, the HRTF measurement system according to the technique disclosed in the present specification sequentially determines the position of the sound source for measuring the HRTF next without repeatedly measuring the HRTFs of the already measured positions and measures the HRTFs at all of the measurement points. Therefore, there is no physical or mental burden of the user. In addition, according to the technique disclosed in the present specification, the measurement of the HRTF can be progressed in the living room or can be progressed by using the pet robot or the drone, without the user noticing the measurement in everyday life.

That is, the technique disclosed in the present specification has been described in a form of an example, and the description of the present invention should not be restrictively interpreted. The claims should be taken into account to determine the scope of the technique disclosed in the present specification.

Note that the technique disclosed in the present specification can also be configured as follows.

(1)

An information processing apparatus including:

a detection unit that detects a position of a head of a user;

a storage unit that stores a head related transfer function of the user;

a determination unit that determines a position of a sound source for measuring the head related transfer function of the user based on the position of the head detected by the detection unit and information stored in the storage unit; and a control unit that controls the sound source to output measurement signal sound from the position determined by the determination unit.

(2)

The information processing apparatus according to (1), further including:

a specification unit that specifies the user.

(3)

The information processing apparatus according to (1) or (2), in which the determination unit determines a position of a sound source for measuring the head related transfer function of the user next without overlapping the position where the head related transfer function is already measured.

(4)

The information processing apparatus according to any one of (1) to (3), in which the control unit selects one of a plurality of sound sources arranged at different positions based on the position determined by the determination unit and causes the sound source to output measurement signal sound.

(5)

The information processing apparatus according to any one of (1) to (3), in which the control unit causes the sound source moved based on the position determined by the determination unit to output measurement signal sound.

(6)

The information processing apparatus according to any one of (1) to (5), further including:

a calculation unit that calculates the head related transfer function of the user based on collected sound data obtained by collecting, at the position of the head, the measurement signal sound output from the sound source.

(7)

The information processing apparatus according to (6), further including:

a first determination unit that determines whether or not there is an abnormality in the collected sound data.

(8)

The information processing apparatus according to (7), in which the first determination unit performs the determination by handling, as no-signal, the collected sound data in a time domain in which a measurement signal is not measured due to a metric space delay between the position of the head and the position of the sound source.

(9)

The information processing apparatus according to any one of (6) to (8), further including:

a second determination unit that determines whether or not there is an abnormality in the head related transfer function calculated by the calculation unit.

(10)

The information processing apparatus according to any one of (6) to (9), in which the calculation unit uses collected sound data of measurement signal sound output from the sound source near the position determined by the determination unit to interpolate the head related transfer function at the position determined by the determination unit.

(11)

The information processing apparatus according to any one of (1) to (10), in which the determination unit sequentially determines the position of the sound source for measuring the head related transfer function of the user next so as to evenly measure the head related transfer function throughout an area to be measured.

(12)

The information processing apparatus according to any one of (1) to (10), in which the determination unit sequentially determines the position of the sound source for measuring the head related transfer function of the user next based on a priority set in the area to be measured.

(13)

The information processing apparatus according to any one of (1) to (12), further including:

an information presentation unit that presents information prompting the user to make an action of changing the position of the head when there is no sound source that generates the measurement signal sound at the position of the sound source determined by the determination unit.

(14)

The information processing apparatus according to (13), further including:

a display, in which the information presentation unit presents the information to be viewed by the user at a predetermined position of the display, and causes the sound source that is at a position determined by the determination unit for the head after the change in the position, to generate measurement signal sound when the user faces the information.

(15)

The information processing apparatus according to (13) or (14), including:

a plurality of sound sources, in which the control unit controls a sound source that is arranged at a position determined by the determination unit for the head after the change in the position, to output measurement signal sound.

(16)

The information processing apparatus according to (13), including:

a plurality of sound sources, in which the control unit determines a first sound source among the plurality of sound sources that outputs measurement signal sound, the information presentation unit determines a second sound source among the plurality of sound sources that presents acoustic information prompting the user to make an action, and when the user faces the acoustic information, the first sound source is in a positional relation corresponding to the position determined by the determination unit with respect to the position of the head.

(17)

The information processing apparatus according to any one of (1) to (16), in which the measurement signal sound includes a time-stretch pulse in which power is inversely proportional to frequency.

(18)

The information processing apparatus according to any one of (1) to (16), in which the measurement signal sound includes a time-stretch pulse in which amplitude at each frequency is adjusted according to a frequency spectrum of stationary noise of a measurement environment.

(19)

An information processing method including:

a detection step of detecting a position of a head of a user;

a determination step of determining a position of a sound source for measuring a head related transfer function of the user based on the position of the head detected in the detection step and information stored in a storage unit that stores the head related transfer function of the user; and a control step of controlling the sound source to output measurement signal sound from the position determined in the determination step.

(20)

An acoustic system including:

a control apparatus including a detection unit that detects a position of a head of a user, a storage unit that stores a head related transfer function of the user, a determination unit that determines a position of a sound source for measuring the head related transfer function of the user based on the position of the head detected by the detection unit and information stored in the storage unit, a control unit that controls the sound source to output measurement signal sound from the position determined by the determination unit, and a calculation unit that calculates the head related transfer function of the user based on collected sound data obtained by collecting, at the position of the head, the measurement signal sound output from the sound source; and a terminal apparatus including a sound collection unit that is mounted on the user and used and that collects, at the position of the head, the measurement signal sound output from the sound source, and a transmission unit that transmits data collected by the sound collection unit to the control apparatus.

REFERENCE SIGNS LIST

1 . . . Terminal apparatus, 2 . . . Control box, 3 . . . User specification apparatus

5, 6, 8, 8, . . . Gate

100 . . . HRTF measurement system

101 . . . Storage unit, 102 . . . User specification unit

103 . . . User position posture detection unit, 104 . . . Sound source position determination unit

105 . . . Sound source position changing unit, 106 . . . Acoustic signal generation unit, 107 . . . Calculation unit

108 . . . Communication unit, 109 . . . Sound collection unit, 110 . . . Communication unit

1000 . . . HRTF measurement system, 1001 . . . Sound source position movement apparatus

1101 . . . Pet robot, 1102 . . . Drone, 1103 . . . Chair

1700 . . . Acoustic output system

1701 . . . Position-based HRTF database, 1702 . . . Sound source generation unit

1703 . . . Sound image position control unit, 1704, 1705 . . . Filter

1706, 1707 . . . Filter, 1708, 1709 . . . Amplifier

1710, 1711 . . . Speaker, 1712 . . . Acoustic environment control unit

1713 . . . Ambient acoustic environment database

1714 . . . User interface, 1715 . . . Sensor unit

1800 . . . HRTF measurement system, 1801 . . . Information presentation unit

1900 . . . Room, 1901, 1902, 1903 . . . Speaker

1910, 1920, 1930 . . . Wall surface

1911, 1921, 1931 . . . Display

The invention claimed is:

1. An information processing apparatus, comprising:

a detection unit configured to detect a position of a head of a user;

a storage unit configured to store information associated with a first head related transfer function of the user;

a first determination unit configured to determine, based on the detected position of the head and the stored information, a position of a first measurement point of a plurality of measurement points for measurement of the first head related transfer function of the user, wherein the position of the first measurement point is different from a position of a second measurement point of the plurality of measurement points; and a control unit configured to:

select a first sound source matching or approximate to the determined position of the first measurement point; and control the selected first sound source to output measurement signal sound from the determined position of the first measurement point.

2. The information processing apparatus according to claim 1, further comprising a specification unit configured to specify the user.

3. The information processing apparatus according to claim 1, wherein the first determination unit is further configured to determine a position of a third measurement point of the plurality of measurement points for measurement of a second head related transfer function of the user, and the position of the third measurement point does not overlap the position of the first measurement point where the first head related transfer function is measured.

4. The information processing apparatus according to claim 1, wherein the control unit is further configured to control movement of the first sound source based on the determined position of the first measurement point, and the output of the measurement signal sound is based on the movement of the first sound source.

5. The information processing apparatus according to claim 1, further comprising:

a communication unit configured to receive sound data of the measurement signal sound output from the first sound source; and a calculation unit configured to calculate the first head related transfer function of the user based on the received sound data.

6. The information processing apparatus according to claim 5, further comprising a second determination unit configured to determine an abnormality in the received sound data.

7. The information processing apparatus according to claim 6, wherein the second determination unit is further configured to perform the determination of the abnormality by handling, as no-signal, the received sound data in a time domain in which a measurement signal is not measured due to a metric space delay between the position of the head and the position of the first measurement point.

8. The information processing apparatus according to claim 5, further comprising a third determination unit configured to determine an abnormality in the first head related transfer function calculated by the calculation unit.

9. The information processing apparatus according to claim 5, wherein the calculation unit is further configured to use the received sound data of the measurement signal sound output from the first sound source to interpolate the first head related transfer function at the determined position of the first measurement point.

10. The information processing apparatus according to claim 1, wherein the first determination unit is further configured to sequentially determine a position of a third measurement point of the plurality of measurement points for measurement of a second head related transfer function of the user so as to evenly measure the first head related transfer function and the second head related transfer function throughout an area to be measured.

11. The information processing apparatus according to claim 10, wherein the first determination unit is further configured to sequentially determine, based on a priority set in the area, the position of the third measurement point for the measurement of the second head related transfer function of the user.

12. The information processing apparatus according to claim 1, further comprising an information presentation unit configured to present information that prompts the user to change the position of the head in a case there is no sound source of a plurality of sound sources that generates the measurement signal sound at the determined position of the first measurement point.

13. The information processing apparatus according to claim 12, further comprising a display, wherein the information presentation unit is further configured to:

display the information to the user at a specific position of the display, and control, in a case where the user faces the displayed information, the first sound source that is at the determined position after the change in the position of the head, to generate the measurement signal sound.

14. The information processing apparatus according to claim 12, wherein the control unit is further configured to control the first sound source that is at the determined position after the change in the position of the head, to output the measurement signal sound.

15. The information processing apparatus according to claim 12, wherein the control unit is further configured to determine the first sound source that outputs the measurement signal sound, the information presentation unit is further configured to determine a second sound source that presents acoustic information that prompts the user to make an action, and in a case where the user faces the acoustic information, the first sound source is in a positional relation corresponding to the determined position with respect to the position of the head.

16. The information processing apparatus according to claim 1, wherein the measurement signal sound includes a time-stretch pulse in which power is inversely proportional to frequency.

17. The information processing apparatus according to claim 1, wherein the measurement signal sound includes a time-stretch pulse in which amplitude at each frequency is adjustable based on a frequency spectrum of stationary noise of a measurement environment.

18. An information processing method, comprising:

detecting a position of a head of a user;

storing, in a storage unit, information associated with a head related transfer function of the user;

determining, based on the detected position of the head and the stored information, a position of a first measurement point of a plurality of measurement points for measuring the head related transfer function of the user, wherein the position of the first measurement point is different from a position of a second measurement point of the plurality of measurement points;

selecting a first sound source matching or approximate to the determined position of the first measurement point; and controlling the selected first sound source to output measurement signal sound from the determined position of the first measurement point.

19. An acoustic system, comprising:

a control apparatus including:

a detection unit configured to detect a position of a head of a user, a storage unit configured to store information associated with a head related transfer function of the user, a determination unit configured to determine, based on the detected position of the head and the stored information, a position of a first measurement point of a plurality of measurement points for measurement of the head related transfer function of the user, wherein the position of the first measurement point is different from a position of a second measurement point of the plurality of measurement points, a control unit that configured to:

select a first sound source matching or approximate to the determined position of the first measurement point, and control the selected first sound source to output measurement signal sound from the determined position of the first measurement points, a communication unit configured to receive sound data of the measurement signal sound output from the first sound source, and a calculation unit configured to calculate the head related transfer function of the user based on the received sound data; and a terminal apparatus including:

a sound collection unit mounted on the user, wherein the sound collection unit is configured to collect, at the position of the head, the measurement signal sound output from the first sound source, and a transmission unit configured to transmit the sound data of the collected measurement signal sound to the control apparatus.

* * * * *